US007518462B2

(12) United States Patent
Kanno et al.

(10) Patent No.: US 7,518,462 B2
(45) Date of Patent: Apr. 14, 2009

(54) TRANSMISSION LINE PAIR HAVING A PLURALITY OF ROTATIONAL-DIRECTION REVERSAL STRUCTURES

(75) Inventors: Hiroshi Kanno, Osaka (JP); Kazuyuki Sakiyama, Osaka (JP); Ushio Sangawa, Nara (JP); Tomoyasu Fujishima, Osaka (JP)

(73) Assignee: Panasonic Corporation, Osaka (JP)

( * ) Notice: Subject to any disclaimer, the term of this patent is extended or adjusted under 35 U.S.C. 154(b) by 0 days.

(21) Appl. No.: 11/589,099

(22) Filed: Oct. 30, 2006

(65) Prior Publication Data

US 2007/0040627 A1 Feb. 22, 2007

Related U.S. Application Data

(63) Continuation of application No. PCT/JP2006/306531, filed on Mar. 29, 2006.

(30) Foreign Application Priority Data

Mar. 30, 2005 (JP) ..... 2005-097370

(51) Int. Cl.
*H01P 3/08* (2006.01)

(52) U.S. Cl. ..... 333/4; 333/238

(58) Field of Classification Search ..... 333/4, 333/5, 238, 246

See application file for complete search history.

(56) References Cited

U.S. PATENT DOCUMENTS 3,609,600 A 9/1971 Kassabgi
4,375,053 A 2/1983 Viola et al.
5,818,308 A * 10/1998 Tanaka et al. ..... 333/116

(Continued)

FOREIGN PATENT DOCUMENTS

JP 4-196601 A 7/1992

(Continued)

OTHER PUBLICATIONS

Japanese Office Action issued in corresponding Japanese Patent Application No. JP 2006-524146, dated Mar. 13, 2007.

(Continued)

*Primary Examiner*—Benny Lee
(74) *Attorney, Agent, or Firm*—McDermott Will & Emery LLP

(57) ABSTRACT

A transmission line pair has two transmission lines placed adjacent to each other in parallel to a signal transmission direction of the transmission lines as a whole. Each of the transmission lines includes a first signal conductor which is placed on one surface of a substrate formed from a dielectric or semiconductor and which is formed so as to be curved toward a first rotational direction within the surface, and a second signal conductor which is formed so as to be curved toward a second rotational direction opposite to the first rotational direction and which is placed in the surface so as to be electrically connected in series to the first signal conductor. A transmission-direction reversal portion in which a signal is transmitted along a direction reversed with respect to the signal transmission direction of the transmission lines as a whole is formed so as to include at least part of the first signal conductor and part of the second signal conductor. Thus, the transmission line pair is enabled to maintain successful isolation characteristics.

9 Claims, 32 Drawing Sheets

U.S. PATENT DOCUMENTS

| | | | | |
|---|---|---|---|---|
| 6,026,311 | A | 2/2000 | Willemsen Cortes et al. | |
| 6,029,075 | A * | 2/2000 | Das | 505/210 |

FOREIGN PATENT DOCUMENTS

| | | | |
|---|---|---|---|
| JP | 7-46010 | | 2/1995 |
| JP | 11-17409 | A | 1/1999 |
| JP | 2000-77911 | A | 3/2000 |
| JP | 2004-274172 | | 9/2004 |

OTHER PUBLICATIONS

Japanese Office Action issued in corresponding Japanese Patent Application No. JP 2006-524147, dated Mar. 13, 2007.

"An Introduction ot Signal Integrity," Jun. 1, 2002, pp. 79, CQ Publishing Co., Ltd.

* cited by examiner

"PRIOR ART"

"PRIOR ART"

"PRIOR ART"

"PRIOR ART"

"PRIOR ART"

"PRIOR ART"

"PRIOR ART"

TRANSMISSION LINE PAIR HAVING A PLURALITY OF ROTATIONAL-DIRECTION REVERSAL STRUCTURES

This is a continuation application of International Application No. PCT/JP2006/306531, filed Mar. 29, 2006.

BACKGROUND OF THE INVENTION

1. Field of the Invention

The present invention relates to a transmission line pair, or a transmission line group, in which transmission lines for transmitting analog radio-frequency signals of microwave band, millimeter-wave band or the like or digital signals are placed in a pair in coupling-enabled manner, and further relates to a radio-frequency circuit which contains such a transmission line pair.

2. Description of the Related Art

FIG. 26A shows a schematic cross-sectional structure of a microstrip line which has been used as a transmission line in such a conventional radio-frequency circuit as shown above. As shown in FIG. 26A, a signal conductor 103 is formed on a top face of a board 101 made of a dielectric or semiconductor, and a grounding conductor layer 105 is formed on a rear face of the board 101. Upon input of radio-frequency power to this microstrip line, an electric field arises along a direction from the signal conductor 103 to the grounding conductor layer 105, and a magnetic field arises along such a direction as to surround the signal conductor 103 perpendicular to lines of electric force. As a result, the electromagnetic field propagates the radio-frequency power in a lengthwise direction perpendicular to the widthwise direction of the signal conductor 103. In addition, in the microstrip line, the signal conductor 103 or the grounding conductor layer 105 does not necessarily need to be formed on the top face or the rear face of the board 101, but the signal conductor 103 or the grounding conductor layer 105 may be formed within the inner-layer conductor surface of the circuit board on condition that the board 101 is provided as a multilayer circuit board.

The above description has been made on a transmission line for use of transmission of single-end signals. However, as shown in a sectional view of FIG. 26B, two microstrip line structures may be provided in parallel so as to be used as differential signal transmission lines with signals of opposite phases transmitted through the lines, respectively. In this case, since paired signal conductors 103*a*, 103*b* have signals of opposite phases flow therethrough, the grounding conductor layer 105 may be omitted.

In a conventional analog circuit or high-speed digital circuit, a cross-sectional structure of which is shown in FIG. 27A and a top view of which is shown in FIG. 27B, two or more transmission lines 102*a*, 102*b* having terminals 106*a-d* are often placed in adjacency and parallel to each other with a high density in their placement distance, giving rise to a crosstalk phenomenon between the adjoining transmission lines with the issue of isolation deterioration involved, in many cases. As shown in non-patent document 1, the origin of the crosstalk phenomenon can be attributed to both mutual inductance and mutual capacitance.

Now the principle of occurrence of a crosstalk signal is explained with reference to a perspective view of FIG. 28 (a perspective view corresponding to the structure of FIGS. 27A and 27B) of a transmission line pair of two lines placed in parallel and in adjacency to each other with the dielectric substrate 101 assumed as a circuit board. Two linear transmission lines 102*a*, 102*b* are so constructed that the grounding conductor 105 formed on the rear face of the dielectric substrate 101 is used as their grounding conductor portions while two signal conductors placed in adjacency and parallel to each other on a top face 281 of the dielectric substrate 101 are used as their signal conductor portions. Assuming that both ends of these transmission lines 102*a*, 102*b* are terminated by unshown resistors, respectively, radio-frequency circuit characteristics of the two transmission lines 102*a*, 102*b* can be understood by substituting current-flowing closed current loops 293*a*, 293*b* for the two transmission lines 102*a*, 102*b*, respectively.

Also, as shown in FIG. 28, each of current loops 293*a*, 293*b* is made up of a signal conductor which makes a current flow on a top face 281 of the dielectric substrate 101, a grounding conductor 105 on the substrate rear face on which a return current flows, and a resistive element (not shown) which connects the two conductors to each other in a direction vertical to the dielectric substrate 101. It is noted here that the resistive element introduced in such a circuit (i.e., in a current loop) may be not a physical element but a virtual one in which its resistance components are distributed along the signal conductors, where the resistive element may be regarded as one having the same value of characteristic impedance as that of the transmission lines.

Next, the crosstalk phenomenon that would arise upon a flow of a radio-frequency signal in each current loop 293*a* is concretely explained with reference to FIG. 28. First, as a radio-frequency current 853 flows in the current loop 293*a* along a direction indicated by arrow in the figure upon transmission of a radio-frequency signal, a radio-frequency magnetic field 855 is generated so as to intersect the current loop 293*a*. Since the two transmission lines 102*a*, 102*b* are placed in proximity to each other, the radio-frequency magnetic field 855 intersects even the current loop 293*b* of the transmission line 102*b*, so that an induced current 857 flows in the current loop 293*b*. This is the principle of development of a crosstalk signal due to mutual inductance.

Based on this principle, the induced current 857 generated in the current loop 293*b* flows toward a near-end side terminal (i.e., a terminal in an end portion on the front side in the figure) in a direction opposite to the direction of the radio-frequency current 853 in the current loop 293*a*. Since intensity of the radio-frequency magnetic field 855 depends on the loop area of the current loop 293*a* and since intensity of the induced current 857 depends on the intensity of the radio-frequency magnetic field 855 intersecting the current loop 293*b*, the crosstalk signal intensity increases more and more as a coupled line length Lcp of the transmission line pair composed of the two transmission lines 102*a*, 102*b* increases.

Further, besides the crosstalk phenomenon due to mutual inductance, another crosstalk signal is induced to the transmission line 102*b* due to the mutual capacitance occurring to between the two signal conductors as well. The crosstalk signal generated by the mutual capacitance has no directivity, and occurs to both far-end and near-end sides each at an equal intensity. Now, current elements generated in the transmission line pair in accompaniment to the crosstalk phenomenon during transmission of high-speed signals are shown in a schematic explanatory view of FIG. 29. As shown in FIG. 29, when a voltage ±Vo is applied to a terminal 106*a* on the left side of the transmission line 102*a* as in the figure, a radio-frequency current element Io flows through the transmission line 102*a* due to a radio-frequency component contained at a pulse leading edge. A difference between a current Ic generated due to a mutual capacitance by this radio-frequency current element Io and a current Ii generated due to the mutual inductance flows as a crosstalk current into a far-end side crosstalk terminal 106*d* of the adjacently placed transmission line 102*b*. On the other hand, a crosstalk current corresponding to the sum of currents Ic and Ii flows into a near-end side crosstalk terminal 106*c*. As shown above, under a condition that paired transmission lines are placed in proximity to each other at a high density, the current Ii is generally higher in intensity than the current Ic, and therefore a crosstalk voltage Vf of the negative sign, which is inverse to the sign of the voltage ±Vo applied to the terminal 106*a*, is observed at the far-end side crosstalk terminal 106*d*. Therefore, reduction of the mutual inductance is needed in order to suppress the effect of the crosstalk.

Here is explained a typical example of crosstalk characteristics in conventional transmission lines. For example, as shown in FIGS. 27A and 27B, on a top face of a dielectric substrate 101 of resin material having a dielectric constant of 3.8 and a thickness H (FIG. 27A) of 250 μm and having a grounding conductor layer 105 (FIG. 27A) provided over its entire rear face, is fabricated a radio-frequency circuit having a structure that two signal conductors, i.e. transmission lines 102*a* and 102*b*, with a wiring width W of 100 μm are placed in parallel with a wire-to-wire gap G set to 650 μm, where one radio-frequency circuit defined here and having a coupled line length Lcp of 5 mm (referred to herein as Prior Art Example 1)and another of 50 mm (referred to herein as Prior Art Example 2). A wiring distance D, which is a placement distance of the two transmission lines 102*a*, 102*b*, is G+(W/2)×2=750 μm. It is noted that those signal conductors are provided each by a copper wire having an electrical conductivity of $3\times10^8$ S/m and a thickness of 20 μm.

With respect to such radio-frequency circuit structures of Prior Art Examples 1 and 2, forward transit characteristics by four terminal measurement (terminal 106*a* to terminal 106*b*) as well as far-end directed isolation characteristics (terminal 106*a* to terminal 106*d*) are explained below with reference to a graph-form view showing the frequency dependence of the isolation characteristics about the radio-frequency circuits of Prior Art Examples 1 and 2 shown in FIG. 30. It is noted that in the graph of FIG. 30, the horizontal axis represents frequency (GHz) and the vertical axis represents isolation characteristic S41 (dB).

As shown by the isolation characteristic S41 of FIG. 30, the crosstalk intensity goes higher with increasing frequency. More specifically, in Prior Art Example 1 (Lcp=5 mm) indicated by thin line in the figure, it can be understood that even an isolation of 30 dB with the frequency band of 5 GHz or higher, or 25 dB with the frequency band of 10 GHz or higher, or the isolation characteristic of 20 dB with the frequency band of 20 GHz or higher cannot be satisfied. Also, in Prior Art Example 2 (Lcp=50 mm) indicated by solid line in the figure, it can be understood that even an isolation of 12 dB with the frequency band of 5 GHz or higher, or 7 dB with the frequency band of 10 GHz or higher, or as small as 3 dB with the frequency band of 20 GHz or higher cannot be ensured. The more the signal involved becomes higher in frequency, and further the more the coupled line length Lcp becomes longer, the more the crosstalk intensity tends to monotonously increase. Also when the placement distance D is decreased, the crosstalk intensity monotonously increases.

Non-patent document 1: An introduction to signal integrity (CQ Publishing Co., Ltd., 2002), pp. 79

SUMMARY OF THE INVENTION

However, the conventional microstrip lines have principle-based issues shown below.

The forward crosstalk phenomenon that occurs from parallel placement of a plurality of conventional microstrip lines can cause of malfunctions of the circuit from the following two viewpoints. The first point is that, at an output terminal to which an input terminal of a transmission signal is connected, there occurs an unexpected decrease in signal intensity, so that a circuit malfunction occurs. The second point is that, among wide-band frequency components that are contained in the transmission signal, in particular, higher-frequency components involve higher leak intensity, so that the crosstalk signal has a very sharp peak, a malfunction occurs in the circuit to which the adjacent transmission line is connected. In particular, such crosstalk phenomena becomes noticeable when the coupled line length Lcp is set over 0.5 time or more the effective wavelength λg of electromagnetic waves of the radio-frequency components contained in the transmitted signal.

In the radio-frequency circuit of Prior Art Example 2 described above, upon input of a pulse having a rise time and a fall time each of 50 picoseconds and a pulse voltage of 1 V was inputted to the terminal 106*a*, a crosstalk waveform observed at the far-end side terminal 106*d* is shown in FIG. 31. It is noted that in FIG. 31, the vertical axis represents voltage (V) and the horizontal axis represents time (nsec). As shown in FIG. 31, the absolute value of the observed crosstalk voltage Vf reached as much as 175 mV. In addition, that the sign of a crosstalk signal corresponding to the rising edge of the positive-sign pulse voltage resulted in the opposite sign is due to the fact, as described above, that the crosstalk current Ii induced by the mutual inductance was larger in intensity than the crosstalk current Ic generated by an effect of the mutual capacitance.

On the other hand, however, in order to meet strict demands for circuit miniaturization from the market, a radio-frequency circuit needs to be implemented in a dense placement with the shortest possible distance between adjacent circuits or distance between transmission lines by using fine circuit formation techniques. Further, generally, since semiconductor chips or boards have been going larger and larger in size along with the diversification of treated applications including not only sound data but also image data or moving image data, the distance along which connecting wires are adjacently led around between circuits is elongated, so that the coupled line length of the parallel coupled lines has been keeping on increasing. Moreover, with increases in speeds of transmission signals, the line length effectively increases even in parallel coupled line length that has been permitted in conventional radio-frequency circuits, so that the crosstalk phenomenon has been becoming noticeable. That is, for the conventional transmission line technique, it is desired to form, with a saved area, a radio-frequency circuit in which high isolation is maintained in radio-frequency band, but it is difficult to meet the desire, disadvantageously. On the other hand, however, in order to meet strict demands for circuit miniaturization from the market, a radio-frequency circuit needs to be implemented in a dense placement with the shortest possible distance between adjacent circuits or distance between transmission lines by using fine circuit formation techniques. Further, generally, since semiconductor chips or boards have been increasing in size along with the diversification of the types of applications using the semiconductor chips or board which include not only sound data but also image data or moving image data, the distance along which connecting wires are formed around circuit components has become elongated, so that the coupled line length of the parallel coupled lines has been continuously increasing. Moreover, with increases in speeds of transmission signals, the line length effectively increases even in parallel coupled line length that has been permitted in conventional radio-frequency circuits, so that the crosstalk phenomenon has become more noticeable. That is, for the conventional transmission line technique, it is desired to form a radio-frequency circuit in which high isolation is maintained in radio-frequency band, but it is difficult to meet the desire.

Therefore, an object of the present invention, related solving the above-described problems, is to provide a transmission line pair, as well as a transmission line group, which serves for transmitting analog radio-frequency signals of microwave band or millimeter-wave band or the like or digital signals, and in which satisfactory isolation characteristics can be maintained.

In order to achieve the above object, the present invention has the following constitutions.

According to a first aspect of the present invention, there is provided a transmission line pair having two transmission lines placed adjacent to each other in parallel to a signal transmission direction of the transmission lines, each of the transmission lines comprising:

a first signal conductor which is placed on one surface of a substrate formed from a dielectric or semiconductor and which is formed so as to be curved toward a first rotational direction within the surface; and a second signal conductor which is formed so as to be curved toward a second rotational direction opposite to the first rotational direction and which is placed in the surface of the substrate so as to be electrically connected in series to the first signal conductor, wherein a transmission-direction reversal portion in which a signal is transmitted along a direction reversed with respect to the signal transmission direction of the transmission lines as a whole is formed so as to include at least part of the first signal conductor and part of the second signal conductor.

That is, in the two transmission lines, a rotational direction reversal structure is formed, wherein the linear first signal conductor is formed so as to be curved toward the first rotational direction, a terminating end of the first signal conductor and a starting end of the second signal conductor are electrically connected to each other, and the linear second signal conductor is formed so as to be curved toward the signal transmission direction It is noted here that the term "rotational-direction reversal structure" refers to an electrically continued line which is formed by a linear signal conductor and which has such a structure that a direction of a signal transmitted in the line is reversed from the first rotational direction to the second rotational direction.

Further, in each of the transmission lines, a "transmission-direction reversal portion" in which a signal is transmitted along a direction reversed with respect to the signal transmission direction of the transmission lines as a whole is formed so as to include at least part of the first signal conductor and part of the second signal conductor or another signal conductor.

By adopting the transmission line pair of the first aspect, it becomes possible to reduce mutual inductance between adjacently placed transmission lines, so that crosstalk intensity can be reduced. Also, in the rotational-direction reversal structures within the transmission lines, since the signal conductor is formed so as to be curved at least two times in different directions, a radio-frequency current is structurally led toward locally in different directions with respect to the signal transmission direction of the transmission lines as a whole. The reason that mutual inductance which causes crosstalk is increased in conventional transmission lines lies in the placement relation of two transmission lines that a radio-frequency magnetic field generated in one transmission line intersects its adjacent transmission line as well at all times because the radio-frequency current would flow along a direction parallel to the adjacent transmission line at all times. However, the more the local direction in which the current is traveled in the adjacent transmission line is shifted from the parallel relation, the more the condition that the radio-frequency magnetic field generated in one transmission line and its adjacent transmission line intersect each other is relaxed. Furthermore, by inclining the local traveling direction of the transmission line to more than 90 degrees, a current loop formed by the transmission line is locally cut off, so that its area is limited, making it possible to effectively reduce the mutual inductance. Thus, with the structure of the transmission lines of the first aspect, it becomes possible to lower the mutual inductance with the adjacent transmission line and reduce the crosstalk amount.

Further, by the provision of the transmission-direction reversal portion for reversing the signal transmission direction, it becomes possible to generate a reverse-directed induced current in the transmission-direction reversal portion so that the amount of induced current totally generated in the whole transmission lines can be reduced, making it possible to further reduce the crosstalk amount.

According to a second aspect of the present invention, there is provided the transmission line pair as defined in the first aspect, wherein the two transmission lines are equal in line length to each other.

According to a third aspect of the present invention, there is provided the transmission line pair as defined in the first aspect, wherein a center-to-center distance of wiring regions of the individual transmission lines is set to 1.1 to 2 times as large as a width of each of the wiring regions of the transmission lines.

According to a fourth aspect of the present invention, there is provided the transmission line pair as defined in the first aspect, wherein the two transmission lines are placed so as to be in mirror symmetry to each other.

According to a fifth aspect of the present invention, there is provided the transmission line pair as defined in the first aspect, wherein the two transmission lines are identical in line shape to each other and have such a placement relation that one of the transmission lines is translated along a direction vertical to the signal transmission direction.

According to a sixth aspect of the present invention, there is provided the transmission line pair as defined in the first aspect, wherein the two transmission lines are identical in line shape to each other and have such a placement relation that one of the transmission lines is translated along the signal transmission direction and along a direction vertical to the signal transmission direction.

According to a seventh aspect of the present invention, there is provided the transmission line pair as defined in the first aspect, wherein in each of the two transmission lines, the curve of each of the first signal conductor and the second signal conductor is circular-arc shaped.

According to an eighth aspect of the present invention, there is provided the transmission line pair as defined in the first aspect, wherein in each of the two transmission lines, the first signal conductor and the second signal conductor are placed in point symmetry with respect to a center of a connecting portion between the first signal conductor and the second signal conductor.

According to a ninth aspect of the present invention, there is provided the transmission line pair as defined in the first aspect, wherein in each of the two transmission lines, each of the first signal conductor and the second signal conductor has the curved shape having a rotational angle of 180 degrees or more.

According to a tenth aspect of the present invention, there is provided the transmission line pair as defined in the first aspect, wherein in each of the two transmission lines, the transmission-direction reversal portion has its signal transmission direction which is a direction having an angle of more than 90 degrees with respect to the signal transmission direction of the transmission lines as a whole.

According to an eleventh aspect of the present invention, there is provided the transmission line pair as defined in the tenth aspect, wherein the transmission-direction reversal portion has its signal transmission direction which is a direction having an angle of 180 degrees with respect to the signal transmission direction of the transmission lines as a whole.

According to a twelfth aspect of the present invention, there is provided the transmission line pair as defined in the first aspect, wherein each of the two transmission lines further comprises a third signal conductor (a conductor-to-conductor connection use signal conductor) for electrically connecting the first signal conductor and the second signal conductor to each other, and wherein the transmission-direction reversal portion is formed so as to include the third signal conductor.

According to a thirteenth aspect of the present invention, there is provided the transmission line pair as defined in the first aspect, wherein in each of the two transmission lines, the first signal conductor and the second signal conductor are electrically connected to each other via a dielectric, and wherein the dielectric, the first signal conductor and the second signal conductor make up a capacitor structure.

According to a fourteenth aspect of the present invention, there is provided the transmission line pair as defined in the first aspect, wherein in each of the two transmission lines, the first signal conductor and the second signal conductor are set to line lengths, respectively, which are non-resonant at a frequency of a transmission signal.

According to a fifteenth aspect of the present invention, there is provided the transmission line pair as defined in the twelfth aspect, wherein the third signal conductor is set to a line length which is non-resonant at a frequency of a transmission signal.

According to a sixteenth aspect of the present invention, there is provided the transmission line pair as defined in the first aspect, wherein in each of the two transmission lines, a plurality of rotational-direction reversal structures each formed with electrical connection between the first signal conductor and the second signal conductor are connected to one another in series along the signal transmission direction of the transmission lines as a whole.

According to a seventeenth aspect of the present invention, there is provided the transmission line pair as defined in the sixteenth aspect, wherein adjacent rotational-direction reversal structures are connected to each other by a fourth signal conductor.

According to an eighteenth aspect of the present invention, there is provided the transmission line pair as defined in the seventeenth aspect, wherein the fourth signal conductor is placed along a direction different from the signal transmission direction of the transmission lines.

According to a nineteenth aspect of the present invention, there is provided the transmission line pair as defined in the sixteenth aspect, wherein in each of the two transmission lines, the plurality of rotational-direction reversal structures are placed over an effective line length which is 0.5 time or more as long as an effective wavelength at a frequency of a transmission signal.

According to a 20th aspect of the present invention, there is provided the transmission line pair as defined in the sixteenth aspect, wherein in each of the two transmission lines, the plurality of rotational-direction reversal structures are placed over an effective line length which is 1 time or more as long as an effective wavelength at a frequency of a transmission signal.

According to a 21st aspect of the present invention, there is provided the transmission line pair as defined in the sixteenth aspect, wherein in each of the two transmission lines, the plurality of rotational-direction reversal structures are placed over an effective line length which is 2 times or more as long as an effective wavelength at a frequency of a transmission signal.

According to a 22nd aspect of the present invention, there is provided the transmission line pair as defined in the sixteenth aspect, wherein in each of the two transmission lines, the plurality of rotational-direction reversal structures are placed over an effective line length which is 5 times or more as long as an effective wavelength at a frequency of a transmission signal.

According to a 23rd aspect of the present invention, there is provided a transmission line group in which at least one pair of the transmission line pair as defined in the first aspect is given a differential signal so as to function as differential transmission lines.

As in the sixteenth aspect, when the transmission line is formed by connecting the plurality of rotational-direction reversal structures in series to one another, advantageous effects of the present invention can be given to the transmission signal continuously. Also, the plurality of rotational-direction reversal structures may be connected to one another either in direct connection or, as in the seventeenth aspect, via the fourth signal conductor.

As in the nineteenth aspect or twentieth aspect, when the rotational-direction reversal structures are arrayed continuously over an effective line length which is 0.5 time or more, more preferably 1 time or more, as long as the effective wavelength at the frequency of the transmission signal, the crosstalk suppression effect can be enhanced in the transmission line pair of the present invention. Further, as in the twenty-first aspect or twenty-second aspect, when the rotational-direction reversal structures are arrayed continuously over an effective line length which is 2 times or more, more preferably 5 times or more, as long as the effective wavelength at the frequency of the transmission signal, the crosstalk suppression effect with the adjacent transmission line structure can be further enhanced in the transmission line pair of the present invention.

Furthermore, in the transmission line pair of the present invention, with a view to avoiding the resonance of transmission signals, it is preferable that the first and second signal conductors, as well as the third signal conductor and the fourth signal conductor, are set to line lengths shorter than wavelengths of transmitted electromagnetic waves, respectively. Concretely, it is preferable that the effective line length of each structure is set to ¼ or less of the effective wavelength of the electromagnetic wave at the frequency of the transmission signal.

Also, within the rotational-direction reversal structure of the transmission line pair of the present invention, it is preferable that the first signal conductor and the second signal conductor are placed in a rotational-symmetrical relation about a rotational axis which is a center of a connecting portion between the first signal conductor and the second signal conductor or the third signal conductor that connects the first signal conductor and the second signal conductor to each other. Moreover, even if the rotational symmetry cannot be fully maintained for some reason, the advantageous effects of the present invention can be obtained by setting the first signal conductor and the second signal conductor equal in the number of rotations Nr to each other.

Also, when the third signal conductor and the fourth signal conductor are set along a direction which is not completely parallel to the signal transmission direction of the transmission lines as a whole, mutual inductance generated against the adjacent transmission line at sites of both signal conductors can be reduced, so that the advantageous effects of the present invention can be further enhanced.

Also, when two transmission lines of the present invention are placed adjacent to each other, the crosstalk intensity can be reduced as compared to when two conventional transmission lines are placed adjacent to each other with the same wiring density. The relation of two transmission lines may be either a parallel relation of translation in a direction vertical to the signal transmission direction or a mirror-symmetry relation. Further, when one of the two lines in a parallel relation or mirror-symmetry relation is further translated additionally in the signal transmission direction, the crosstalk intensity can be further reduced. An optimum addition translation length is one half the set a cycle of the plurally provided rotational-direction reversal structures.

Also, when two transmission lines of the present invention are placed in adjacent to each other and signals of opposite phases are associated with the two transmission lines, respectively, it becomes practicable for differential signal transmission lines to have the advantageous effects of the present invention. In this case, a mirror-symmetry placement of the two transmission lines makes it possible to avoid an unnecessary mode change from the differential transmission mode to the common mode. Further, for the same reason, when a differential signal line pair using two transmission lines of the present invention is placed in two pairs or more, the individual differential signal line pairs are preferably placed in a mirror-symmetry relation for practical use.

According to the transmission line pair of the present invention, since generation of unnecessary crosstalk signals to the adjacent transmission line can be avoided, there can be provided a radio-frequency circuit which is quite high in wiring density, area-saving, and less liable to malfunctions even during high-speed operation.

BRIEF DESCRIPTION OF THE DRAWINGS

These and other aspects and features of the present invention will become clear from the following description taken in conjunction with the preferred embodiments thereof with reference to the accompanying drawings, in which.

DETAILED DESCRIPTION OF THE PREFERRED EMBODIMENTS

Figure 1:
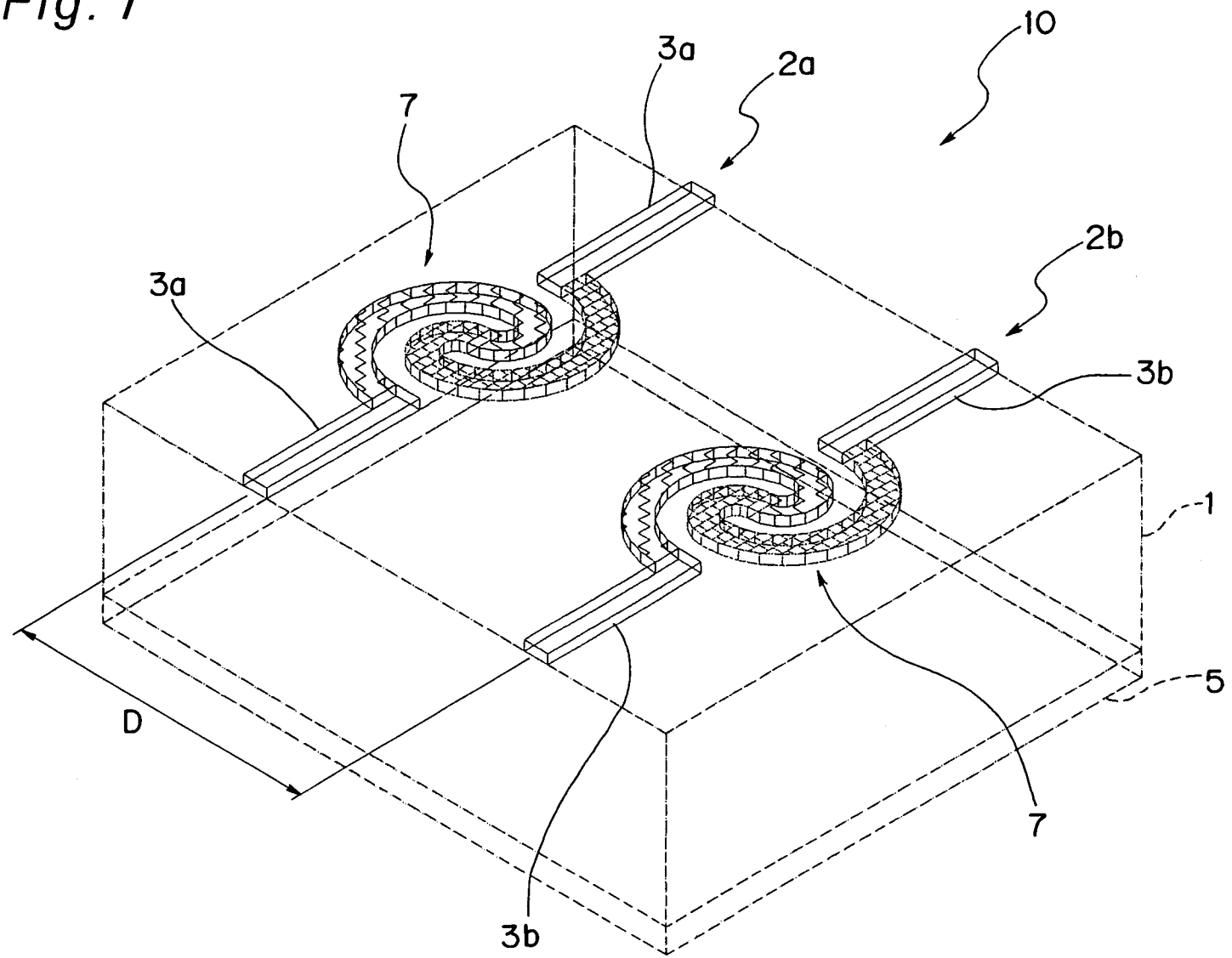
FIG. 1 is a schematic perspective view of a transmission line pair according to one embodiment of the present invention.

Before the description of the present invention proceeds, it is to be noted that like parts are designated by like reference numerals throughout the accompanying drawings, and may not be described in detail for all drawing figures.

Hereinbelow, one embodiment of the present invention is described in detail with reference to the accompanying drawings.

Now, with respect to an embodiment of the present invention, the principle of suppression of the unwanted radiation and moreover the principle of improvement of isolation from proximate transmission lines will be described with reference to the accompanying drawings.

Embodiment

FIG. 1 shows a schematic plan view of a transmission line pair 10 which is so constructed that two transmission lines according to an embodiment of the present invention are adjacently placed in parallel and coupling-enabled manner to each other. As shown in FIG. 1, the transmission line pair 10 includes two signal conductors 3*a*, 3*b* formed on a top face of a dielectric (or semiconductor) substrate 1, and a grounding conductor layer 5 formed on a rear face of the dielectric substrate 1, by which two transmission lines 2*a*, 2*b* having signal transmission directions as a whole parallel to each other and having line lengths equal to each other are made up. The signal conductors 3*a*, 3*b* each include a signal conductor portion having a roughly spiral-shaped rotational structure that is a later-described rotational-direction reversal structure 7. First, a concrete explanation will be made on a detailed structure of the rotational-direction reversal structure 7 of such transmission lines 2*a*, 2*b* shown above as well as on the principle of unwanted radiation suppression obtained by the structure and on the principle of isolation improvement.

Figure 2A:
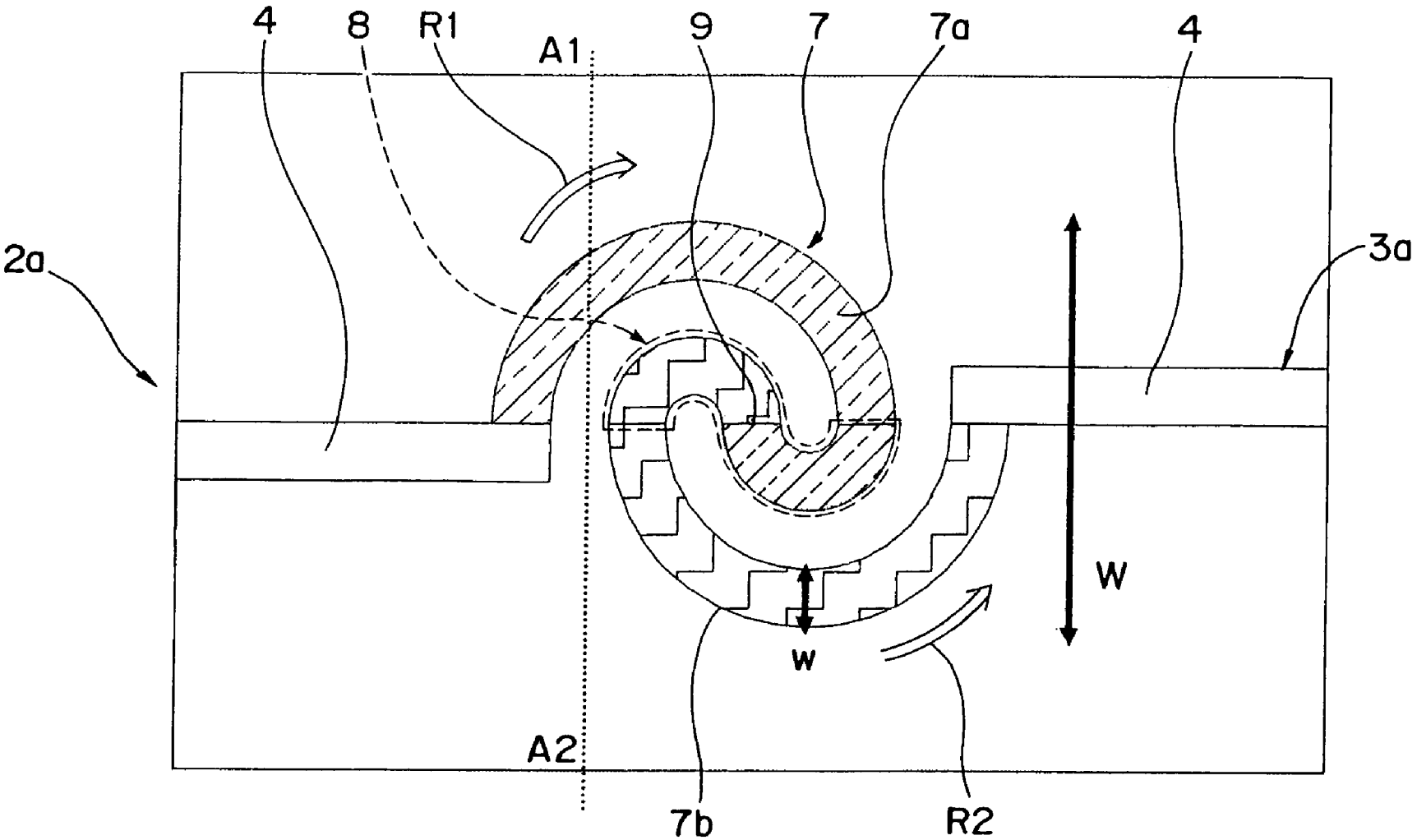
FIG. 2A is a schematic plan view of one transmission line in the transmission line pair of FIG. 1.
Figure 2B:
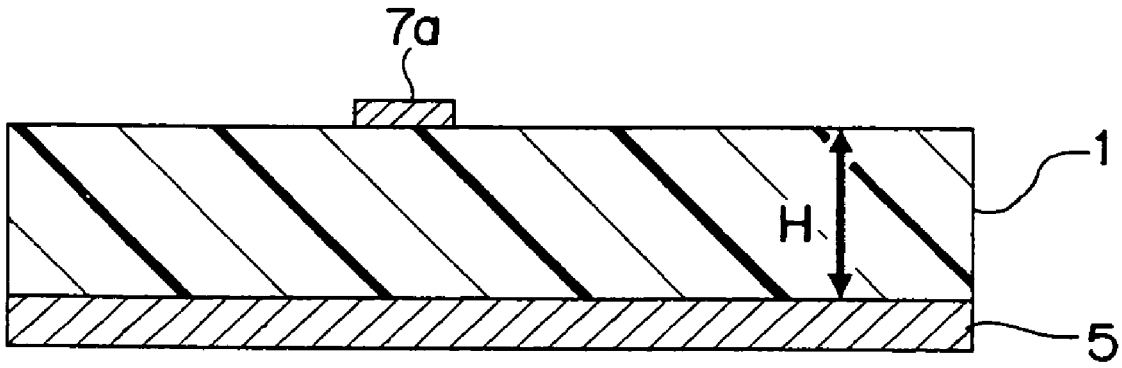
FIG. 2B is a schematic sectional view of the transmission line of FIG. 2A taken along the line A1-A2.

In conjunction with this description, FIG. 2A shows a schematic plan view in which one transmission line 2*a* extracted from the transmission line pair 10 shown in FIG. 1 is schematically shown, and FIG. 2B shows a sectional view of the transmission line 2*a* of FIG. 2A taken along the line A1-A2.

As shown in FIGS. 2A and 2B, the signal conductor 3*a* is formed on a top face of the dielectric substrate 1 having a thickness H and the grounding conductor layer 5 is formed on its rear face, making up the transmission line 2*a*. Assuming that the signal is transmitted from the left to the right side as viewed in FIG. 2A, the signal conductor 3*a* of the transmission line 2*a* of this embodiment has a structure, at least in part of the region, that a first signal conductor 7*a* and a second signal conductor 7*b* are electrically connected to each other at a connecting portion 9, where the first signal conductor 7*a* functions to rotate a radio-frequency current by just one rotation in a spiral shape (i.e., 360-degree rotation) along a first rotational direction (clockwise direction in the figure) R1 within the surface of the substrate 1, and the second signal conductor 7*b* functions to rotate a radio-frequency current by just one rotation in a spiral shape along a second rotational direction (counterclockwise direction in the figure) R2, which is opposite to the first rotational direction R1, (i.e., reverse rotation). In this embodiment, such a structure forms a rotational-direction reversal structure 7. It is noted that in the signal conductor 3*a* shown in FIG. 2A, the first signal conductor 7*a* and the second signal conductor 7*b* are hatched in mutually different patterns for a clear showing of ranges of the first signal conductor 7*a* and the second signal conductor 7*b*.

As shown in FIG. 2A, the rotational-direction reversal structure 7, which is formed of a signal conductor having a specified line width w, and a wiring region width W, includes the first signal conductor 7*a* having a spiral shape of a smooth circular arc formed so as to be curved toward the first rotational direction R1, the second signal conductor 7*b* having a spiral shape of a smooth circular arc formed so as to be curved toward the second rotational direction R2, and the connecting portion 9 which electrically connects one end portion of the first signal conductor 7*a* and one end portion of the second signal conductor 7*b* to each other. Further, as shown in FIG. 2A, with a base point given by a center of the connecting portion 9, the first signal conductor 7*a* and the second signal conductor 7*b* are in rotational symmetry (or point symmetry), where an axis (not shown) extending vertically through the dielectric substrate 1 at the center of the connecting portion 9 corresponds to the rotational axis of the rotational symmetry.

Further, as shown in FIG. 2A, in the rotational-direction reversal structure 7, the first signal conductor 7*a* is formed into a signal conductor of a spiral shape having a 360-degree rotational structure by the connection between a semicircular-arc shaped signal conductor having a relatively small curvature of its curve and a semicircular-arc shaped signal conductor having a relatively large curvature of its curve. This is the case also with the second signal conductor. Then, two semicircular-arc shaped signal conductors having large curvatures of the curves are electrically connected to each other at the connecting portion 9, by which the rotational-direction reversal structure 7 is made up. In addition, as shown in FIG. 2A, individual end portions of the rotational-direction reversal structure 7, i.e., an outer end portion of the first signal conductor 7*a* and an outer end portion of the second signal conductor 7*b*, are connected to a generally linear-shaped external signal conductor 4.

Also in the rotational-direction reversal structure 7, with the signal transmission direction in the whole transmission line 2 (FIG. 1)assumed as a direction from the left to the right side as viewed in the figure, a transmission-direction reversal portion 8 (a portion surrounded by broken line) for transferring a signal toward a direction reverse to the above-mentioned transmission direction is provided. It is noted that the transmission-direction reversal portion 8 is composed of part of the first signal conductor 7*a* and part of the second signal conductor 7*b*.

Figure 33:
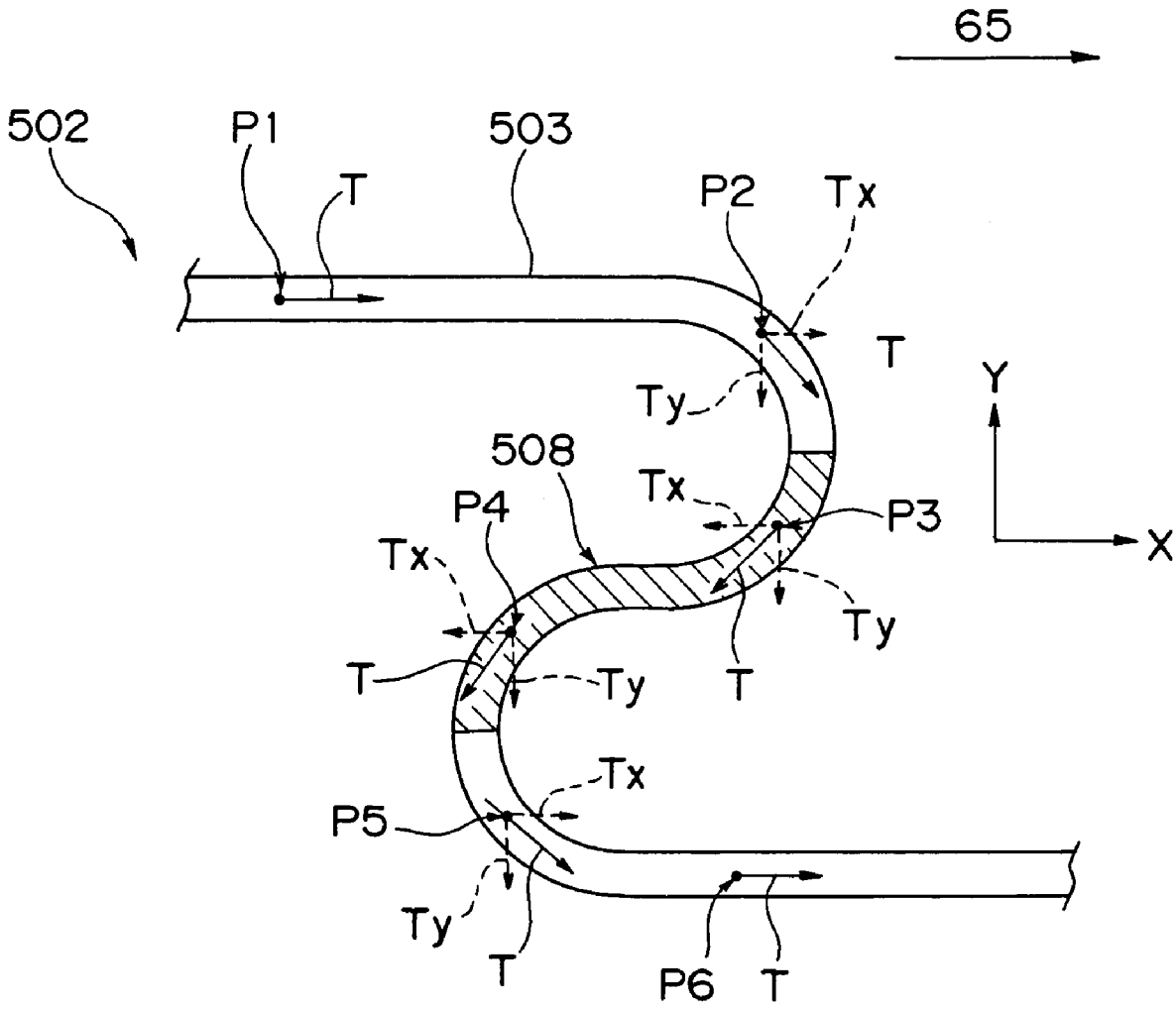
FIG. 33 is a schematic sectional view for explaining a transmission direction and a transmission-direction reversal portion in a transmission line of the foregoing embodiment of the present invention.

Now, the signal transmission direction in a transmission line is explained below with reference to a schematic plan view of a transmission line (one of the transmission lines constituting a transmission line pair) shown in FIG. 33. Herein, the transmission direction is a tangential direction of a signal conductor when the signal conductor has a curved shape, and the transmission direction is a longitudinal direction of a signal conductor when the signal conductor has a linear shape. More specifically, by taking an example of a transmission line 502 formed of a signal conductor 503 having a signal conductor portion of a linear shape and a signal conductor portion of a circular-arc shape as shown in FIG. 33, at local positions P1 and P2 in the linear-shaped signal conductor portion, the transmission direction T is the rightward direction, which is the longitudinal direction of the signal conductor, in the figure. On the other hand, at local positions P2 through P5 in the signal conductor portion of the circular-arc shape, their transmission directions T are tangential directions at the local positions P2 through P5, respectively.

Also, in the transmission line 502 of FIG. 33, assuming that a signal transmission direction 65 in the whole transmission line 502 is the rightward direction as viewed in the figure, and that this direction is an X-axis direction and a direction orthogonal to the X-axis direction within the same plane is a Y-axis direction, then the transmission direction T at each of positions P1 to P6 can be decomposed into Tx, which is a component in the X-axis direction, and Ty, which is a component in the Y-axis direction. Tx becomes a + (positive) X-direction component at positions P1, P2, P5 and P6, while Tx becomes a − (negative) X-direction component at positions P3 and P4. Herein, a portion in which the transmission direction contains a −X-direction component as shown above is a "transmission-direction reversal portion." More specifically, the positions P3 and P4 are positions within a transmission-direction reversal portion 508, and a hatched portion in the signal conductor of FIG. 33 serves as the transmission-direction reversal portion 508. The transmission line of this embodiment necessarily includes such a transmission-direction reversal portion as shown above. It is noted that effects obtained by the placement of such a transmission-direction reversal portion and the like will be explained later.

Figure 3:
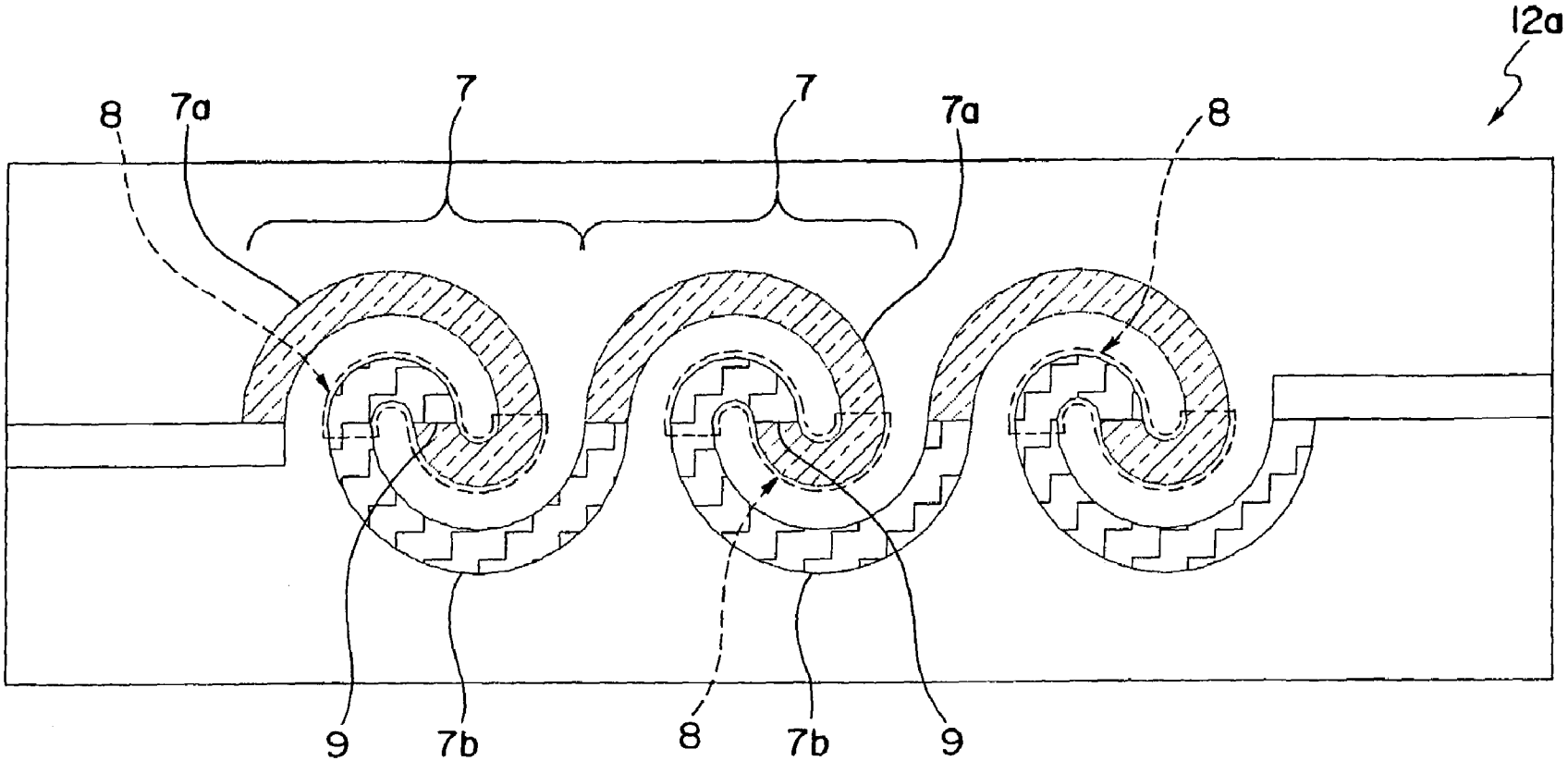
FIG. 3 is a schematic plan view showing one transmission line in the transmission line pair according to a modification of the foregoing embodiment, showing a structure in which a plurality of rotational-direction reversal structures are connected in series.

Also, it is preferable for obtainment of advantageous effects of the present invention that the rotational-direction reversal structures 7 are connected to one another a plurality of times in series to make up a transmission line 12*a* as shown in a schematic plan view of the transmission line 12*a* according to a modification of this embodiment of FIG. 3. In FIG. 3, the individual rotational-direction reversal structures 7 to be adjoined by one another are connected to one another directly without intervention of any other signal conductors. It is noted that in FIG. 3, one transmission line 12*a* out of the transmission line pair according to a modification of this embodiment is shown, and the other unshown transmission line has the same configuration and line length as the transmission line 12*a* shown in FIG. 3.

Figure 4:
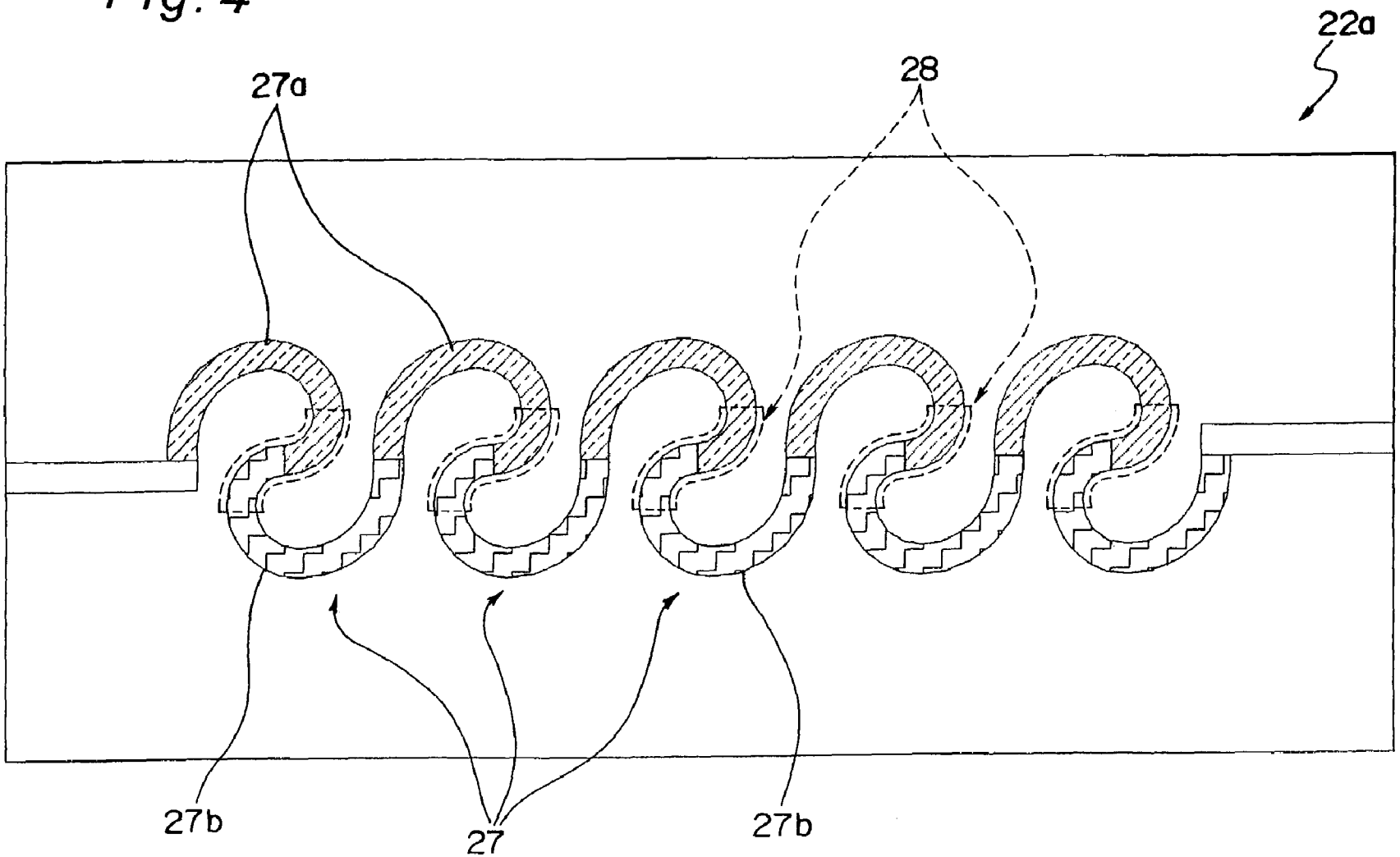
FIG. 4 is a schematic plan view showing one transmission line in the transmission line pair according to a modification of the foregoing embodiment, showing a structure in which the number of rotations of the rotational-direction reversal structure is set to 0.75.
Figure 5:
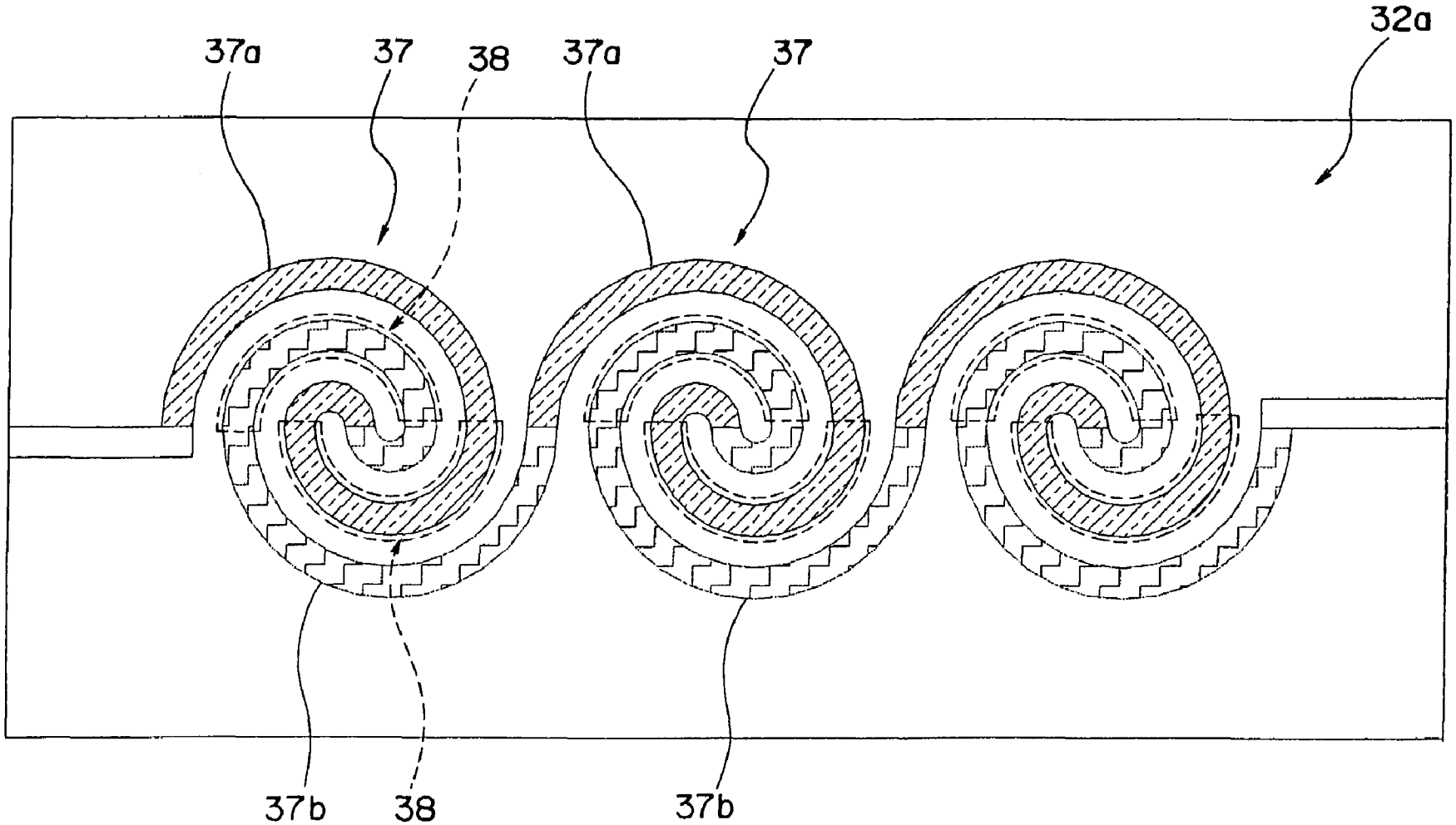
FIG. 5 is a schematic plan view showing one transmission line in the transmission line pair according to a modification of the foregoing embodiment, showing a structure in which the number of rotations of the rotational-direction reversal structure is set to 1.5.

Also, as shown in FIG. 4, which is a schematic plan view of a transmission line 22*a* according to a modification of this embodiment, the case may be that the number of rotations Nr of a first signal conductor 27*a* and a second signal conductor 27*b* within the rotational-direction reversal structure 27 is set to Nr=0.75 time, other than Nr=1 time of the rotational-direction reversal structure 7 in FIG. 2A. Further, as shown in FIG. 5, which is a schematic plan view of a transmission line 32*a*, the case may be that the number of rotations Nr of a first signal conductor 37*a* and a second signal conductor 37*b* within the rotational-direction reversal structure 37 is set to Nr=1.5 times. In either case of the transmission lines 22*a*, 32*a*, the adopted structure includes the rotational-direction reversal structure 27, 37 and a transmission-direction reversal portion 28, 38. In addition, in the transmission line 22*a* of FIG. 4 and the transmission line 32*a* of FIG. 5, portions enclosed by broken line in the figure are the transmission-direction reversal portion 28 (FIG. 4), 38 (FIG. 5). In each rotational-direction reversal structure 37 of the transmission line 32*a* of FIG. 5, the transmission-direction reversal portion 38 is made up from two divisional portions. Further, although not shown, the case may be that the number of rotations Nr is set to ones other than the above. Also in FIGS. 4 and 5, as in FIG. 3, only one transmission line is shown out of the paired transmission lines having an identical configuration and line length.

As to the distance over which the rotational-direction reversal structure is to be provided in the transmission line of the present invention, the following conditions are preferably satisfied in consideration of crosstalk characteristics between adjacent transmission lines under the condition to be set in ordinary circuit boards that the placement distance D between adjacent transmission lines (e.g., placement distance D of the transmission line pair 10 of FIG. 1) is set to within a range of about 1 to 10 times the wiring width (line width) w of the transmission lines (e.g., wiring width w of the signal conductor 3*a* of FIG. 2A).

That is, given the above ordinary condition, the crosstalk intensity between adjacent transmission lines may take a maximum value when the coupled line length Lcp reaches about 5 times the effective wavelength of the transmission frequency under the condition of a weak coupling between the adjacent transmission lines, while the crosstalk intensity between adjacent transmission lines may take a maximum value when the coupled line length Lcp reaches about 2 times the effective wavelength of the transmission frequency under the condition of an intense coupling between the adjacent transmission lines. For instance, the coupled line length Lcp of 50 mm in the radio-frequency circuit of Prior Art Example 2 corresponds to five times the effective wavelength for the frequency of 20 GHz where the crosstalk intensity has reached a non-negligible value. Also, such a crosstalk phenomenon becomes noticeable when the coupled line length Lcp is set over at least 0.5 time or more the effective wavelength λg at the frequency of the transmitted signal. Accordingly, with a view to the suppression of crosstalk between adjacent transmission line structures, it is preferable that the region in which a plurality of rotational-direction reversal structures are connected to one another is set over a length which is 0.5 time or more, preferably 2 times or more and more preferably 5 times or more, of the effective wavelength λg at the frequency of the transmitted signal.

In addition, the transmission line 2*a* of this embodiment is not limited to the case where the signal conductors 3 are formed on the topmost surface of the dielectric substrate 1, but also may be formed on an inner-layer conductor surface (e.g., inner-layer surface in a multilayer-structure board). Similarly, the grounding conductor layer 5 as well is not limited to the case where it is formed on the bottommost surface of the dielectric substrate 1, but also may be formed on the inner-layer conductor surface. That is, herein, one face (or surface) of the board refers to a topmost surface or bottommost surface or inner-layer surface in a board of a single-layer structure or in a board of a multilayer structure.

Figure 34:
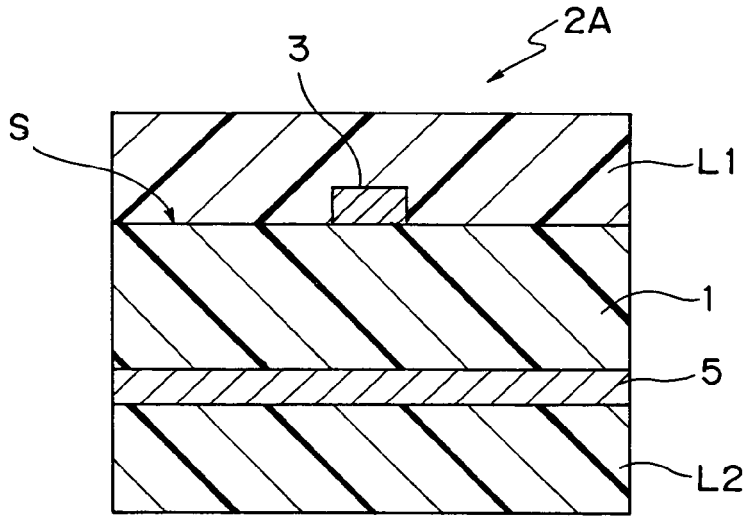
FIG. 34 is a schematic sectional view showing a structure in which another dielectric layer is placed on the surface of a dielectric substrate in the transmission line of the foregoing embodiment.
Figure 35:
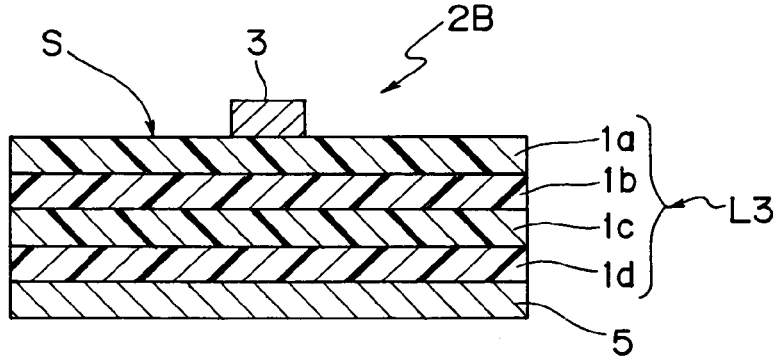
FIG. 35 is a schematic sectional view showing a structure in which the dielectric substrate is a multilayer body in the transmission line of the foregoing embodiment.
Figure 36:
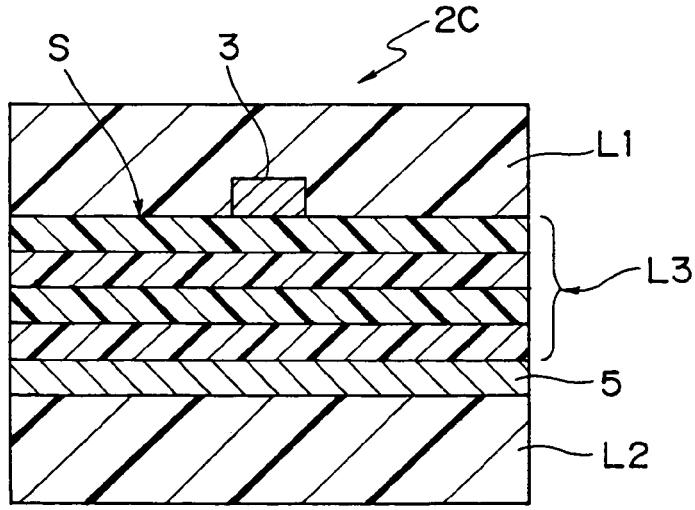
FIG. 36 is a schematic sectional view showing a structure in which the structure of the transmission line of FIG. 34 and the structure of the transmission line of FIG. 35 are combined together in the transmission line of the foregoing embodiment.

More specifically, as shown in a schematic sectional view of a transmission line 2A of FIG. 34 (i.e., a schematic sectional view showing only one transmission line out of two transmission lines constituting a transmission line pair, which hereinafter applies similarly to FIGS. 35 and 36), the structure may be that a signal conductor 3 is placed on one face (upper face in the figure) S of the dielectric substrate 1 while a grounding conductor layer 5 is placed on the other face (lower face in the figure), where another dielectric layer L1 is placed on the one face S of the dielectric substrate 1 while still another dielectric layer L2 is placed on the lower face of the grounding conductor layer 5. Further, like a transmission line 2B shown in a schematic sectional view of FIG. 35, the case may be that the dielectric substrate 1 itself is formed as a multilayer body L3 composed of a plurality of dielectric layers 1*a*, 1*b*, 1*c* and 1*d*, where a signal conductor 3 is placed on one face (upper face in the figure) S of the multilayer body L3 while a grounding conductor layer 5 is placed on the other face (lower face in the figure). Furthermore, it is also possible that, like a transmission line 2C shown in FIG. 36 having a structure in combination of the structure shown in FIG. 34 and the structure shown in FIG. 35, another dielectric layer L1 is placed on one face S of the multilayer body L3 while still another dielectric layer L2 is placed on the lower face of the grounding conductor layer 5. In any of the transmission lines 2A, 2B and 2C of the structures of FIGS. 34 to 36, the surface denoted by reference character S serves as the "surface (one face) of the board."

Figure 6:
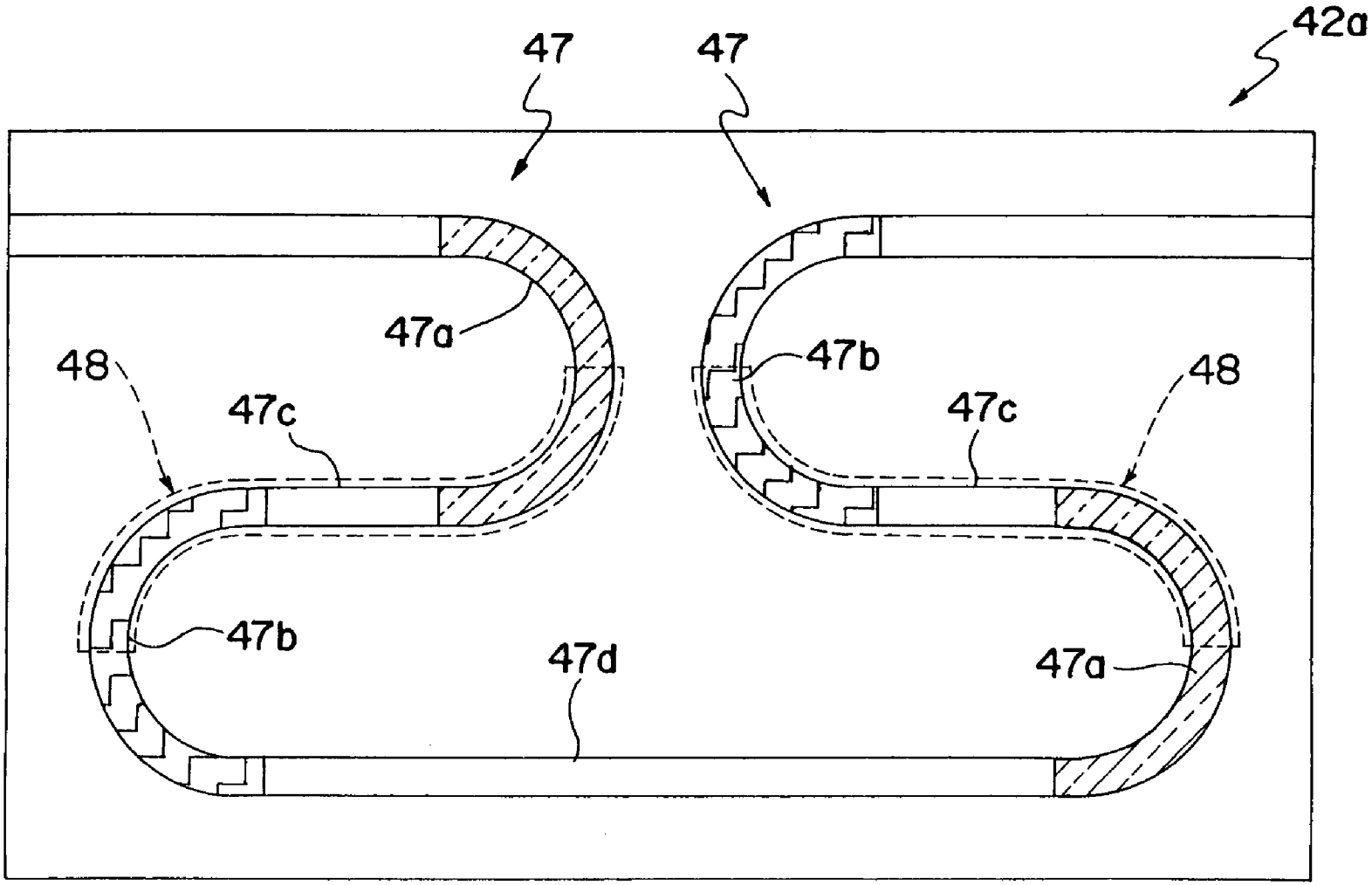
FIG. 6 is a schematic plan view showing one transmission line in the transmission line pair according to a modification of the foregoing embodiment, showing a structure including a third signal conductor and a fourth signal conductor.

Also, in the transmission line 2*a* shown in FIG. 2A, the first signal conductor 7*a* and the second signal conductor 7*b* are connected directly to each other at the connecting portion 9. However, the transmission line according to this embodiment is not limited only to such a case. Instead of such a case, for example, the case may be that, like a transmission line 42*a* shown in a schematic plan view of FIG. 6, a first signal conductor 47*a* and a second signal conductor 47*b* are connected via a third signal conductor 47*c* which is an example of a conductor-to-conductor connection use signal conductor of a linear shape (or non-rotational structure) in a rotational-direction reversal structure 47. In this case, a midpoint of the third signal conductor 47*c* can be set as a rotational axis of 180-degree rotational symmetry. It is noted that in the transmission line 42*a* shown in FIG. 6, a transmission-direction reversal portion 48, which is a portion enclosed by broken line in the figure, is composed of part of the first signal conductor 47*a*, part of the second signal conductor 47*b*, and the entirety of the third signal conductor 47*c*.

Figure 7:
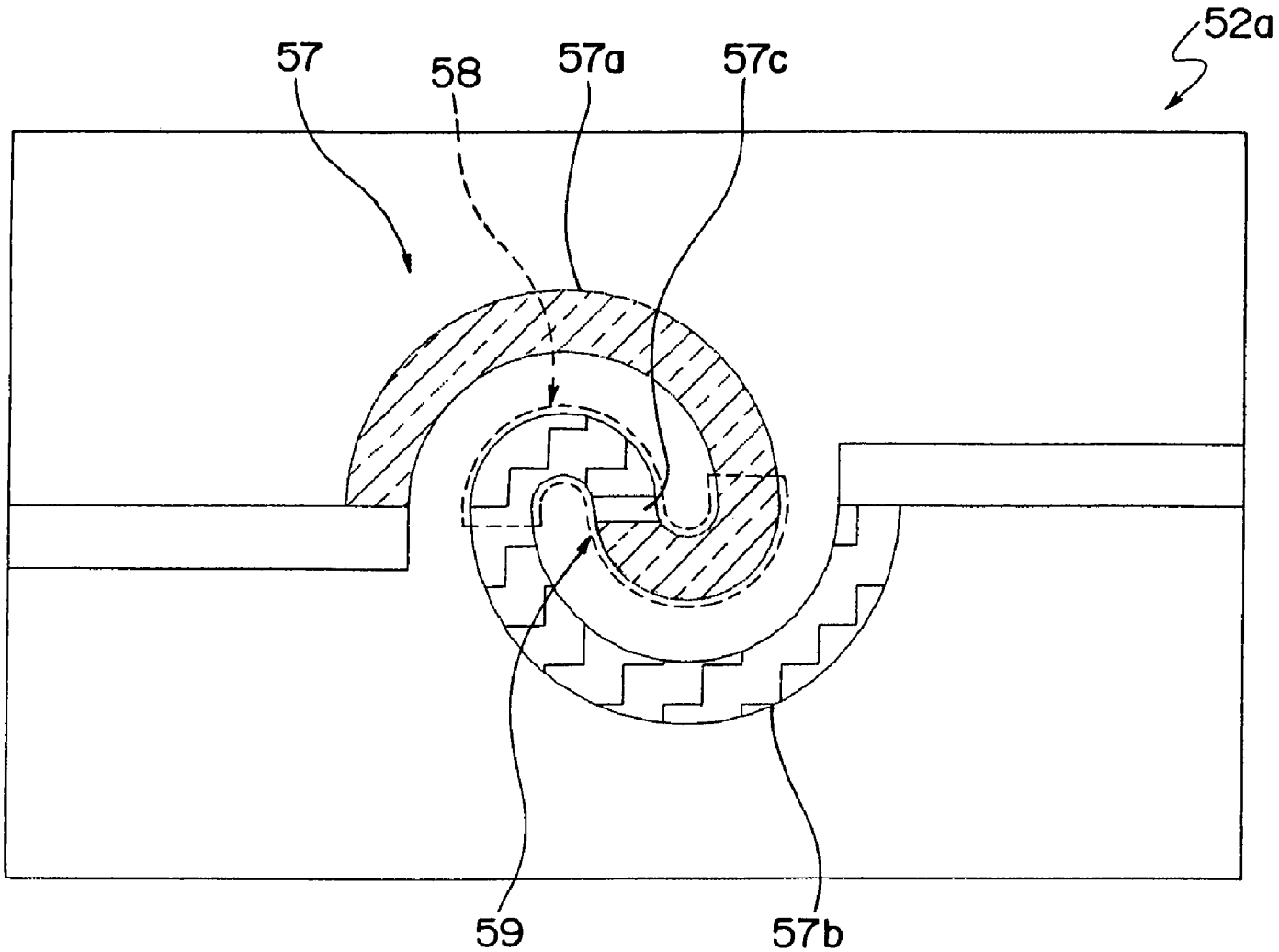
FIG. 7 is a schematic plan view showing one transmission line in the transmission line pair according to a modification of the foregoing embodiment, showing a structure having a capacitor structure.

Also, the case where signal conductors are placed at the connecting portion 9 of the rotational-direction reversal structure 7 is not limitative. Instead of such a case, the case may be that, for example, in a rotational-direction reversal structure 57 of a transmission line 52*a*, a dielectric 57*c* is placed at a connecting portion 59 for electrically connecting a first signal conductor 57*a* and a second signal conductor 57*b* to each other, as shown in FIG. 7, where the two signal conductors are connected to each other in a radio-frequency manner with a capacitor having such a capacitance value that a passing radio-frequency signal is allowed to pass therethrough. In such a case, the rotational-direction reversal structure 57 has a capacitor structure. It is noted that in the transmission line 52*a* of FIG. 7, a transmission-direction reversal portion 58, as enclosed by broken line in the figure, is composed of part of the first signal conductor 57*a*, part of the second signal conductor 57*b*, and the dielectric 57*c*.

Further, in the transmission line 12*a* shown in FIG. 3, adjacent rotational-direction reversal structures 7 are connected directly to one another without intervention of any other conductors. However, the case is not limited to such ones in which direct connection is provided. Instead of such a case, for example, like the transmission line 42*a* shown in FIG. 6, the case may be that adjacent rotational-direction reversal structures 47 are connected to one another via a fourth signal conductor 47*d*, which is an example of a structure-to-structure connection use signal conductor of a linear shape (or non-rotational structure or the like). Furthermore, although not shown, such electrical connection between structures may be fulfilled by forming a capacitor with a capacitance.

Also, the first signal conductor 7*a* and the second signal conductor 7*b*, which are formed each by making a conductor wire curved along a specified rotational direction, do not necessarily need to be spiral circular-arc shaped, but may also be formed by an addition of polygonal and rectangular wire lines, where the signal conductors are preferably formed so as to draw a gentle curve with a view to avoiding unwanted reflection of signals. Since a curved signal transmission path causes a shunt capacitance from a circuit's point of view, the case may be, for reduction of that effect, that the first signal conductor and the second signal conductor are fulfilled partly with their line width w thinner than the line widths of the third signal conductor and the fourth signal conductor.

Also, in one rotational-direction reversal structure, although the numbers of rotations Nr for the first signal conductor and the second signal conductor are not necessarily limited to identical ones in their setting, yet the numbers of rotations Nr are preferably set equal to each other. Further, instead of the case where the number of rotations Nr is considered in one rotational-direction reversal structure, the number of rotations Nr may be set so that a sum of total number of rotations Nr becomes a value close to 0 (zero) by taking into consideration a combination of the first signal conductor and the second signal conductor in one rotational-direction reversal structure as well as a combination of the first signal conductor and the second signal conductor in adjacently placed rotational-direction reversal structures in the one rotational-direction reversal structure, in which case also advantageous effects of the present invention can be obtained.

Also, whereas the transmission line pair made up of transmission lines of an equal line length having at least one or more rotational-direction reversal structures 7, each of which is composed of the first signal conductor 7*a*, the second signal conductor 7*b* and the connecting portion 9 and which includes the transmission-direction reversal portion 8 can obtain the effects of the present invention, it is more preferable, in particular, to use transmission lines in each of which a plurality of such rotational-direction reversal structures as described above are placed.

Next, the principle by which the transmission line of this embodiment make it possible to suppress the crosstalk with its adjacent transmission line, as well as the principle for suppressing unwanted radiation, are described below.

In the transmission line 2*a* constituting the transmission line pair of this embodiment, first, its placement relationship is so devised that each portion of the signal conductor 3*a* does not constantly have a parallel positional relation with its adjacent transmission line 2*b*. As a result of this, the mutual inductance that has been generated against the adjacent transmission line becomes reducible in comparison with the conventional transmission line of linear placement, so that crosstalk intensity suppression effect can be obtained. This devised placement relation can be implemented, for example, by the structure that the first signal conductor 7*a* and the second signal conductor 7*b* are curved along their respective specified rotational directions in the rotational-direction reversal structure 7 included in the transmission line 2*a*.

As already described in conjunction with the background art, the main factor of crosstalk between adjacent transmission lines with the adoption of the conventional transmission line structure is induced current due to the mutual inductance. The cause that mutual inductance between transmission lines becomes more intense in the conventional transmission line pair lies in that a current loop imaginarily formed by one transmission line and a current loop formed by another transmission line are adjacently placed so as to constantly keep parallelism over the section length (i.e., coupled line length) to which the two transmission lines are placed in adjacency to each other. Under this condition, as a radio-frequency signal magnetic flux is generated to intersect a one-side current loop, the radio-frequency magnetic flux necessarily intersects the other-side current loop, thus resulting in a large value of mutual inductance.

In order to reduce such a mutual inductance generated between the two current loops, there are two effective methods, placing two current loops not in parallel but with a relative angle to each other, and reducing the loop area of each current loop. Accordingly, in the transmission line 2*a* constituting the transmission line pair of this embodiment, the rotational-direction reversal structure 7 is introduced into the signal conductor 3*a*, by which effective reduction of the mutual inductance is fulfilled. That is, since the introduction of the rotational-direction reversal structure 7 forcedly makes the signal conductor locally directed toward a direction which is not parallel to the signal transmission direction of the whole transmission line 2*a*, there are positively yielded sites where current loops formed by the transmission lines 2*a*, 2*b* are not parallel in their loop-to-loop placement relation, and moreover at even local sites where the loops are placed parallel to each other, the loop area is considerably reduced in comparison with the case where conventional transmission lines are adopted.

Further, in the transmission lines 2*a*, 2*b* constituting the transmission line pair of this embodiment, the structure is optimized so as to further reduce the mutual inductance generated between the two current loops. That is, in this structure, with an intentional setting of the transmission-direction reversal portion 8 that makes a current flow locally in a direction opposite to the signal transmission direction is intentionally set, an induced current is generated in a direction opposite to that of the normal transmission line so that the total mutual inductance is suppressed.

The principle in which the crosstalk between adjacent transmission lines is reduced in the transmission line of this embodiment by the arrangement that the placement of current loops locally formed by a radio-frequency current traveling within a transmission line is made different from that of conventional microstrip lines is explained below in more detail with reference to the schematic explanatory view shown in FIG. 8.

Figure 28:
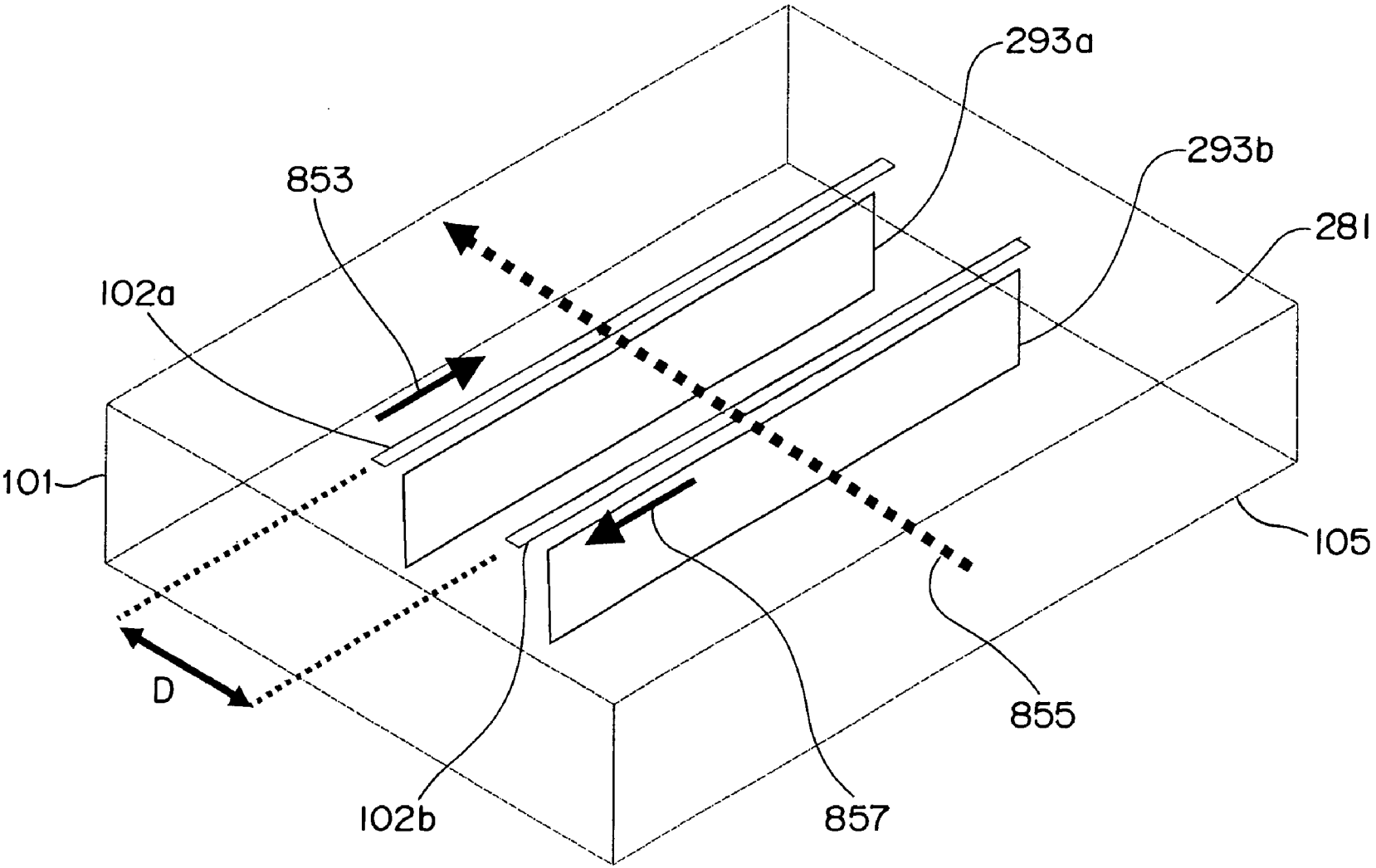
FIG. 28 is a schematic explanatory view for explaining the principle of occurrence of a crosstalk signal due to mutual inductance in a conventional transmission line pair.
Figure 29:
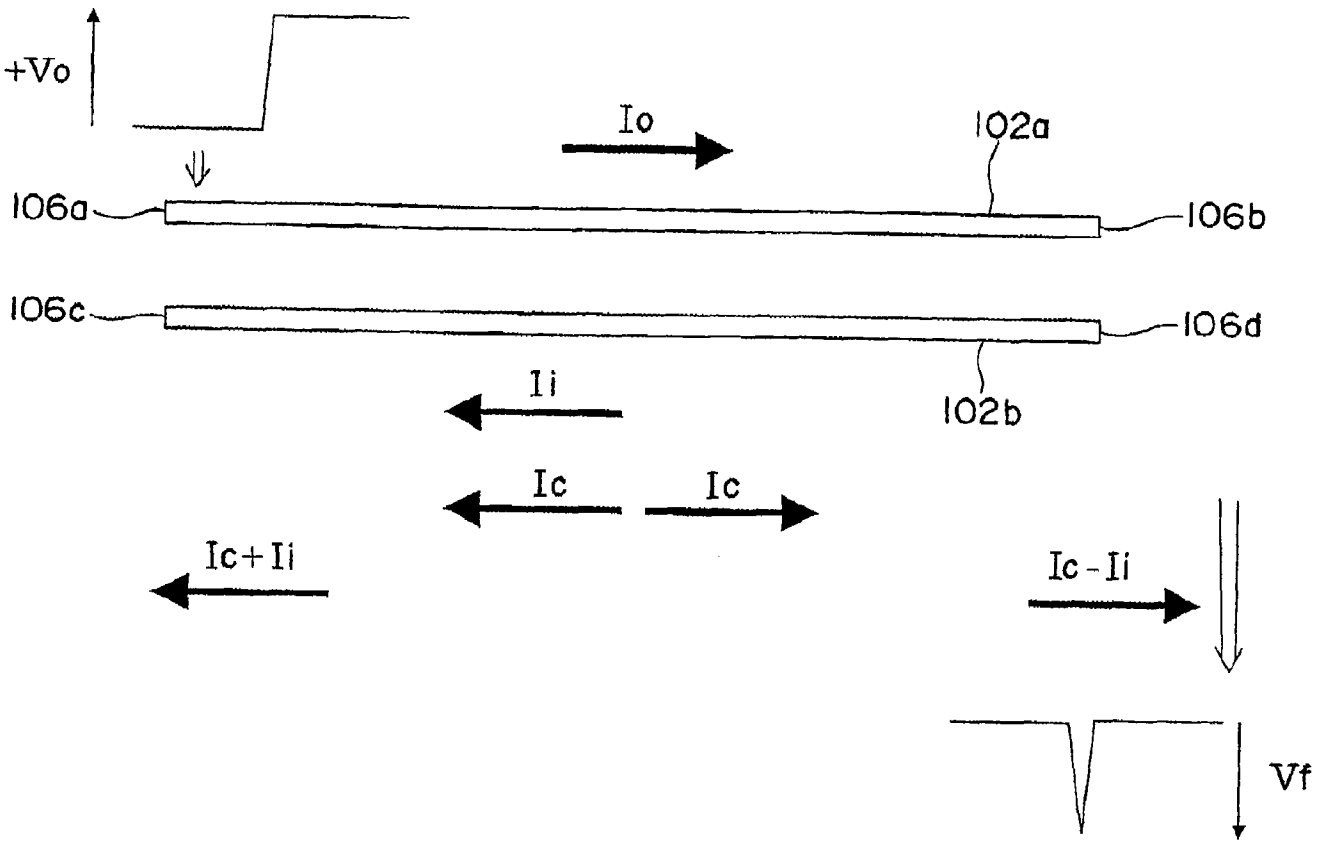
FIG. 29 is a schematic explanatory view showing a relationship of current elements related to the crosstalk phenomenon in a conventional transmission line pair.
Figure 30:
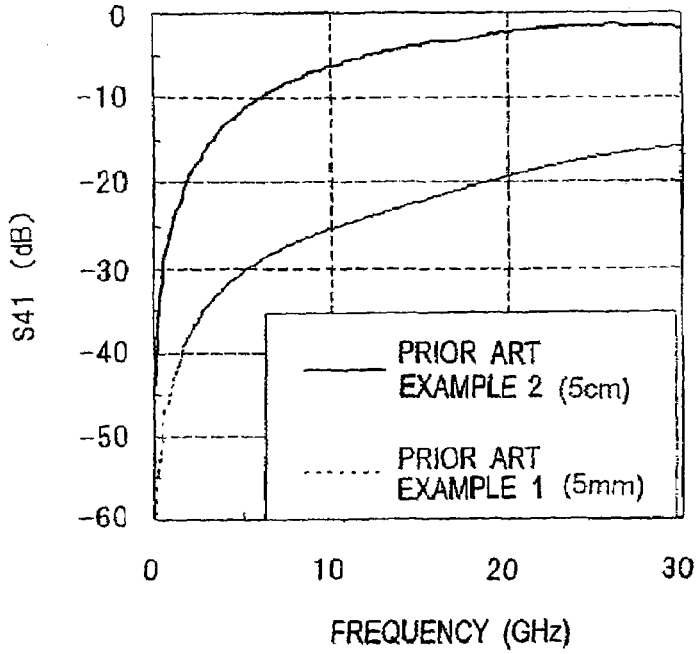
FIG. 30 is a view showing the frequency dependence of crosstalk intensity in the transmission line pairs of Prior Art Examples 1 and 2.

As already described in the background art with reference to the schematic perspective view of FIG. 28, in the transmission line 102*a* of the conventional transmission line pair, as a traveling radio-frequency current 853 flows in the current loop 293*a*, a radio-frequency magnetic field 855 is induced so as to orthogonally intersect the current loop 293*a*. Since the induced radio-frequency magnetic field 855 intersects the current loop 293*b* formed by the adjacent transmission line 102*b*, an induced current 857 that causes the crosstalk based on the mutual inductance is generated. In this case, the intensity of the mutual inductance is proportional to a product of loop areas of the individual current loops of the two transmission lines and a cosine of an angle formed by their directions.

Figure 8:
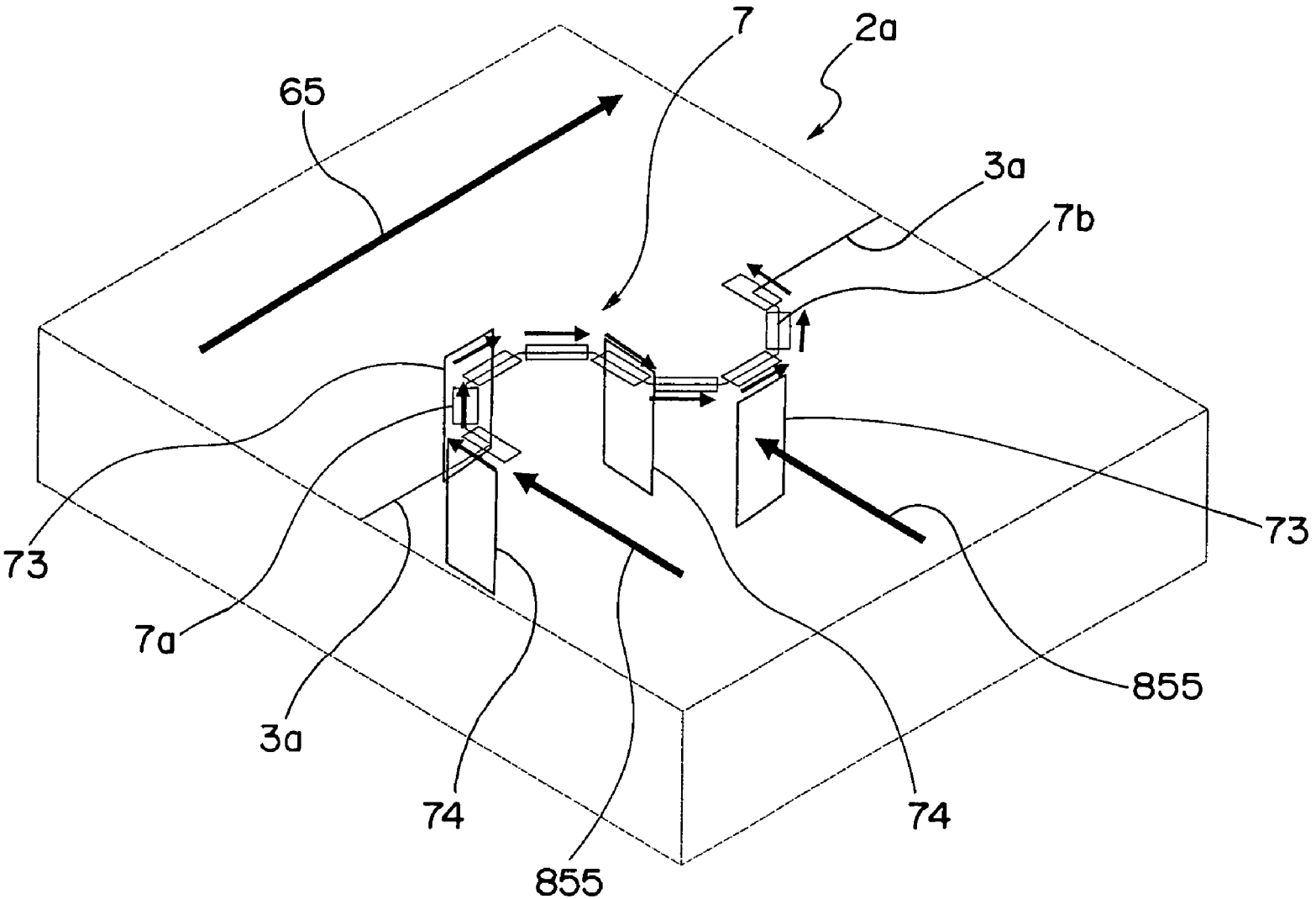
FIG. 8 is a schematic explanatory view for explaining conditions to be satisfied by the current loop within the transmission line pair of the embodiment.

Meanwhile, the schematic explanatory view of FIG. 8 schematically shows a structure in which the number of rotations Nr within each of the rotational-direction reversal structures 7 is 0.5 in the transmission line 2*b* (having the same structure as that of the transmission line 2*a* in the transmission line pair 10) constituting the transmission line pair of this embodiment in which the radio-frequency current travels in the direction of arrow 65. It is noted that whereas the rotational-direction reversal structure 7 included in the transmission line 2*a* in the transmission line pair of this embodiment shown in FIGS. 1 and 2A is so structured as to have a number of rotations Nr of 1, the description using the transmission line 2*b* of FIG. 8 will be given below by using a structure having the number of rotations Nr set to 0.5 for an easier understanding of the description.

Also in FIG. 8, directions of the radio-frequency current at local portions within the transmission line 2*a* are indicated by arrows, and local current loops 73, 74 imaginarily formed by those radio-frequency current elements together with paired return currents of the grounding conductor are partly shown. It is noted that the adjacent transmission line 2*b*, which is placed in parallel to the transmission line 2*a* of this embodiment and subject to crosstalk, is omitted in its depiction for an easier understanding.

As shown in FIG. 8, in the current loop 73 generated at a site where the local direction of the signal conductor 3*a* and the signal transmission direction 65 (signal transmission direction of the transmission lines 2*a*, 2*b* as a whole) are parallel to each other, since the radio-frequency magnetic flux 855 that can intersect the current loop formed by the adjacent transmission line is generated, the induced current due to the mutual inductance is generated in the adjacent transmission line as in the prior art. However, since the transmission line 2*a* in the transmission line pair of this embodiment is so formed that the first signal conductor 7*a* and the second signal conductor 7*b* are bent, there are sites in the signal conductor portions where the signal transmission direction is directionally changed. As a result of this, for example, the current loop 74 at a portion where the signal conductor is locally bent toward a direction orthogonal to the signal transmission direction 65 is, in principle, incapable of generating the magnetic-field direction 855 directed toward the adjacent transmission line, thus having a structure that does not contribute any increase in mutual inductance. Further, at the local bent portion in the signal conductor, there can be seen the start of an effect that the current loop, which would be continuous over the line length in conventional transmission lines, is cut off lengthwise. As a consequence, it can be understood that setting the number of rotations Nr to at least a value beyond 0.5 makes it possible to reduce the loop area of the current loop 73 and suppress the intensity of the mutual inductance. Therefore, for the transmission line pair 10 composed of the transmission line 2*b*, i.e. transmission lines 2*a*, 2*b*, of this embodiment, setting the number of rotations Nr to a value beyond 0.5 makes it possible to reduce the crosstalk intensity as compared with conventional transmission lines.

Figure 9:
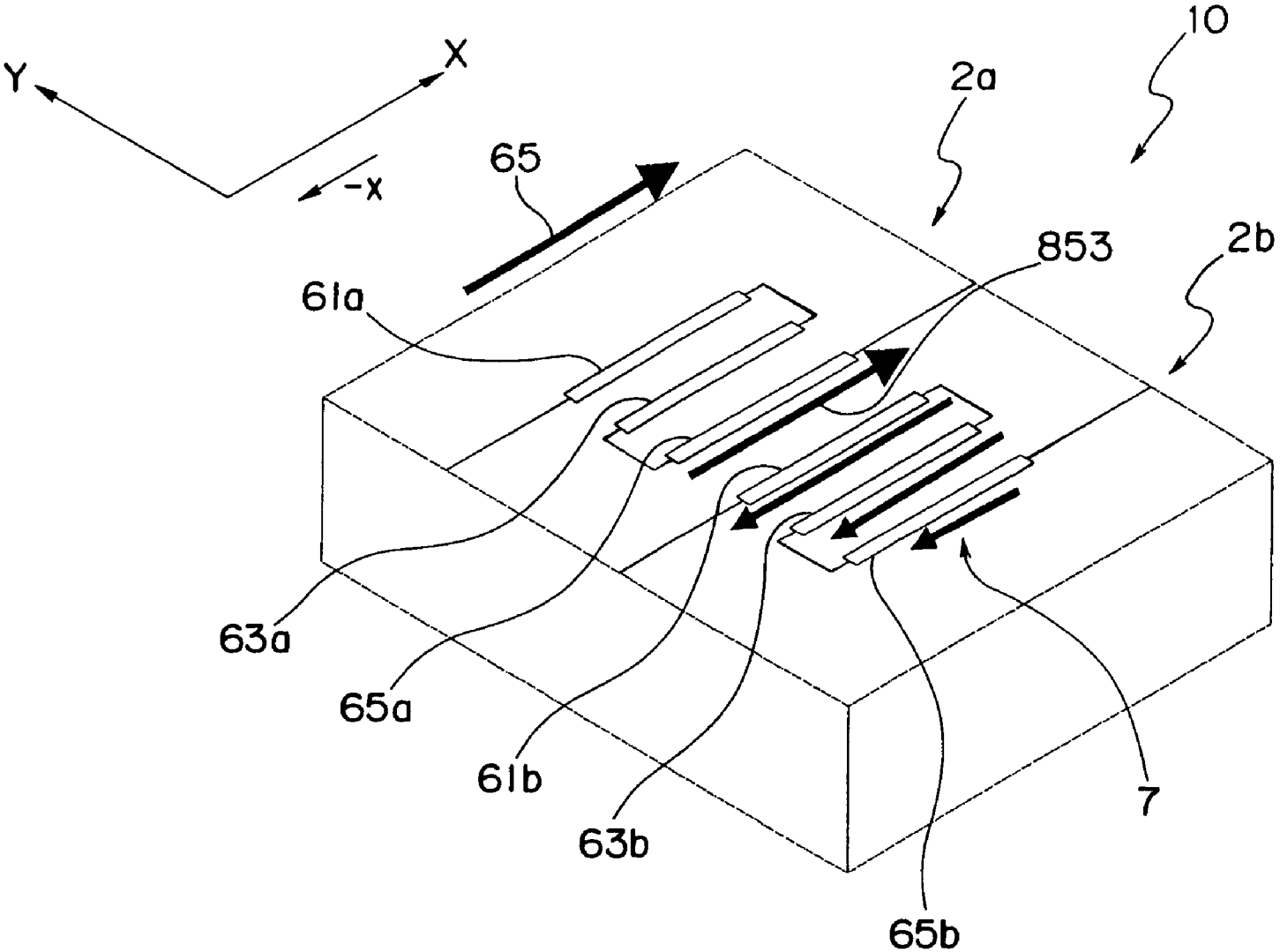
FIG. 9 is a schematic explanatory view showing directions of radio-frequency currents locally traveling in the transmission line pair of the embodiment.

Next, FIG. 9 shows a schematic explanatory view in which directions of radio-frequency currents transmitted in the transmission lines 2*a*, 2*b* are simplified transmission line pair 10 of this embodiment shown in FIG. 1. In addition, portions where the signal conductor is locally placed along a direction vertical to the signal transmission direction 65, which is considered as negligible in terms of contribution to the mutual inductance between the two transmission lines from the description by FIG. 8, are omitted from the schematic explanatory view of FIG. 9. Further, most portions where the signal is transmitted in a direction neither vertical nor parallel but oblique to the signal transmission direction 65 can be decomposed in its components into two directions, vertical and parallel to the transmission direction. Therefore, the rotational-direction reversal structures 7 of the transmission lines 2*a*, 2*b* in the transmission line pair 10 of the structure shown in FIG. 1, respectively, can be shown by approximation to local portions 61*a*, 61*b*, 63*a*, 63*b*, 63*b*, 65*a*, 65*b*, which are six parallel coupled lines, schematically.

As shown in FIG. 9, the transmission line 2*b* of this embodiment has realized a local structure that not only portions where the signal conductor is locally changed in direction are generated at both ends of local portions 61*b* and 65*b* and the like, but also the signal conductor lets a current flow in a direction opposite to the signal transmission direction 65 at a partial local portion 63*b*, that is, a structure including a transmission-direction reversal portion where the signal transmission direction is reversed. As the direction of a current is indicated by arrow in FIG. 9, the induced current generated by the radio-frequency current 853 transmitted in the adjacent transmission line 2*a* occurs in the opposite direction at the local portions 61*b* and 65*b* in the transmission line 2*b* as well as at the local portion 63*b*. Therefore, to an extent to which the induced current (i.e., a current generated in the opposite direction) is generated at the local portion 63*b*, the amount of induced current totally generated in the whole transmission line 2*b* can be reduced and the crosstalk can be suppressed. Herein, the terms, "reverse the signal transmission direction," mean that with the signal transmission direction 65 assumed as the X-axis direction and a direction orthogonal to the X-axis direction assumed as the Y-axis direction, for example, as shown in FIG. 9, a vector representing the direction of a signal transmitted in the signal conductor is made to have at least a −x component generated therein. This condition includes the condition that the number of rotations Nr is set to a value beyond 0.5, as shown also in the description with FIG. 8.

In addition, at the local portion 65*b* in the transmission line 2*b*, which is the farthest in distance to the radio-frequency current 853 transmitted in the transmission line 2*a*, the intensity of the induced current generated at the site is so small that it can be neglected relative to the amount of induced current that is totally generated in the whole transmission line 2*b*. Also, assuming that the wiring distance with the adjacent transmission lines is constant in this embodiment, indeed the local portion 61*b* is made closer to the transmission line 2*a* than in the case where the conventional linear-shaped transmission line is adopted, but the mutual inductance between lines in a close-wiring state tends to be saturated in value with further closer line distance so that the amount of induced current generated at the local portion 61*b* does not become significantly higher as compared with the induced current generated at the local portion 63*b*. As a result of this, the generation of the induced current in the direction opposite to that of the conventional case by the introduction of the local portion 63*b* is enabled to effectively reduce the mutual inductance between transmission lines.

In the schematic explanatory view of FIG. 9, the current direction at the local portion 63*b*, which is discussed in particular in the transmission line 2*b*, is depicted as a direction completely reversed from the signal transmission direction 65. However, if the local portion 63*b* has a direction of an angle of more than 90 degrees to the signal transmission direction 65 (i.e., has a direction having a −x component), a component of the induced current in the opposite direction to the signal transmission direction 65 is partly generated as shown in the schematic explanatory view. Accordingly, in the transmission line 2*b* constituting the transmission line pair of this embodiment, a transmission-direction reversal portion that is a signal conductor for transmitting a signal locally toward a direction different from the signal transmission direction 65 by more than 90 degrees needs to be included in the rotational-direction reversal structure 7, and it is preferable to include a transmission-direction reversal portion for transmitting a signal toward a direction reversed from the signal transmission direction 65 by 180 degrees.

Based on the principle described above with the transmission line pair 10 of this embodiment, particularly preferable conditions that should be satisfied to suppress the crosstalk with the adjacent transmission line in the transmission line of the present invention are shown below.

First, within the rotational-direction reversal structure of the transmission line of the present invention, if the number of rotations Nr of the rotational structure is set to a value beyond 0.5, a site, i.e. transmission-direction reversal portion, where the current is led locally toward a direction different by more than 90 degrees from the signal transmission direction of the whole transmission line within the rotational-direction reversal structure can necessarily be generated, so that the crosstalk suppression effect can effectively be obtained.

Also, even with the number of rotations Nr smaller than 0.5, in the case where, within the rotational-direction reversal structure, a third signal conductor for connecting the first signal conductor and the second signal conductor to each other is adopted or a fourth signal conductor for connecting a plurality of rotational-direction reversal structures to one another is adopted, setting the orientation of at least one site of the signal conductor so that the current is led locally toward a direction different by more than 90 degrees from the signal transmission direction makes it possible to effectively obtain the crosstalk suppression effect.

In addition, in the case where the rotational-direction reversal structures are connected to one another in series by a plurality of times in each of the transmission lines constituting the transmission line pair of the present invention, it is a preferable condition for for obtaining the crosstalk suppression effect to adopt such a placement that, as shown in FIG. 5 as an example, the second signal conductor 37*b* included in one rotational-direction reversal structure 37 and the first signal conductor 37*a* included in another one rotational-direction reversal structure 37 adjacent to the one rotational-direction reversal structure 37 have their rotational directions set opposite to each other.

Figure 10:
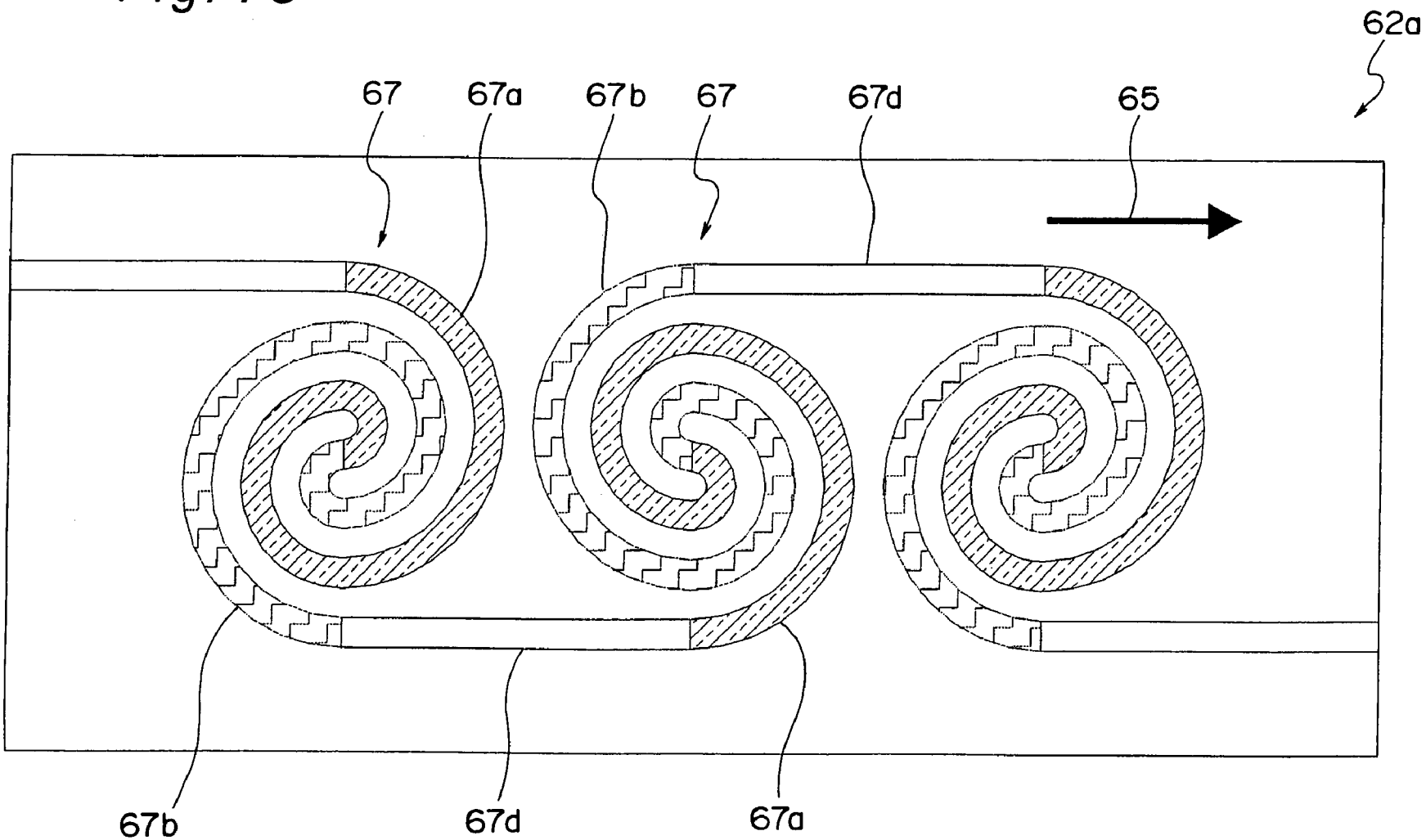
FIG. 10 is a schematic plan view showing one transmission line in the transmission line pair according to a modification of the foregoing embodiment, showing a structure in which rotational directions of adjacent rotational-direction reversal structures are set to mutually opposite directions.

Also, like a transmission line 62*a* shown in a schematic plan view of FIG. 10, adjacent rotational-direction reversal structures 67, may as well be connected to each other by using a fourth signal conductor 67*d* parallel to a signal transmission direction 65 so that a second signal conductor 67*b* included in the rotational-direction reversal structure 67 (placed at the left end in the figure) and a first signal conductor 67*a* included in its adjacent rotational-direction reversal structure 67 (placed in the center of the figure) have their rotational directions set to one identical rotational direction. However, with the structure of the transmission line 62*a* shown in FIG. 10, since the fourth signal conductor 67*d* is placed parallel to the signal transmission direction 65, it cannot be said that the devise made in the transmission line of the present invention for the reduction of mutual inductance is adopted to its full use. That is, since the fourth signal conductor 67*d* is placed in parallel to the adjacent transmission line over a long section length (line length), the result might be that the effect of mutual inductance reduction by the transmission line of the present invention is decreased conversely. Further, with the constitution that the fourth signal conductor 67*d* is placed closest to the adjacent transmission line among the transmission lines, there is another fear that the mutual inductance with the adjacent transmission line might increase unnecessarily.

Figure 11:
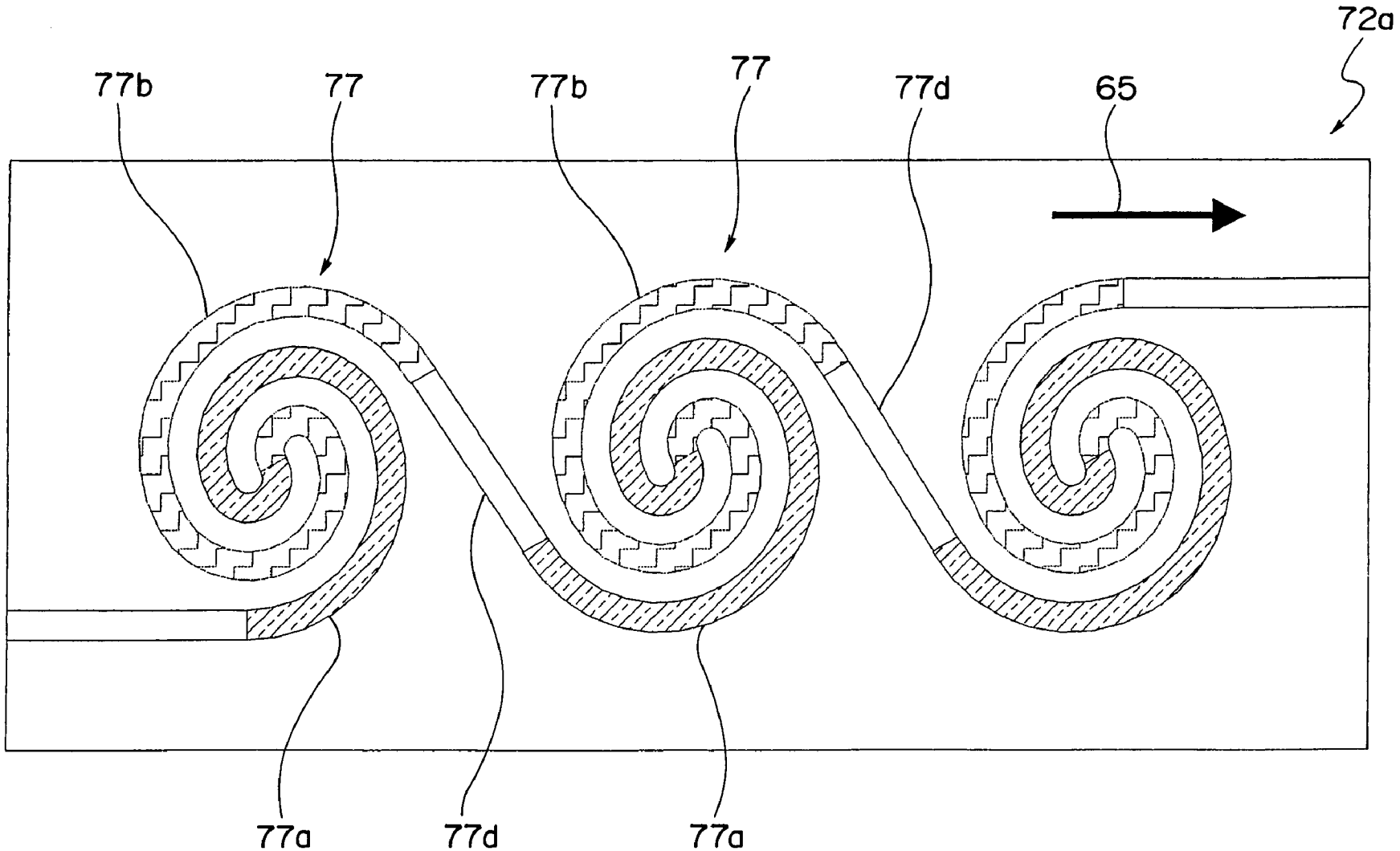
FIG. 11 is a schematic plan view showing a structure in which rotational directions of adjacent rotational-direction reversal structures are set to the same direction in the structure of the transmission line of FIG. 10.

Accordingly, in order to effectively obtain the advantageous effects of the present invention by adopting the rotational-direction reversal structures of an equal number of rotations Nr, it is preferable to adopt a transmission line 72*a* of the structure of FIG. 11 rather than the transmission line 62*a* of the structure of FIG. 10. That is, like the transmission line 72*a* of FIG. 11, a fourth signal conductor 77*d* may as well be placed not in parallel to the signal transmission direction 65 but in a skewed direction thereto. The transmission line 72 of FIG. 11 includes a first signal conductor 77*a* and a second signal conductor 77*b*. In addition, in a structure that the fourth signal conductor 77*d* for connecting adjacent rotational-direction reversal structures 77 to each other is formed into a generally linear shape and moreover placed in a direction skewed with respect to the signal transmission direction 65 as in the transmission line 72*a* of FIG. 11, the individual rotational-direction reversal structures 77 are placed in one identical placement configuration.

Also, since it is not preferable that the phase of a transmission signal is rotated to a substantial extent during the transmission through the fourth signal conductor, the line length of the fourth signal conductor is preferably set to a line length less than one quarter of the effective wavelength at the frequency of the transmitted signal. It is noted that also in FIGS. 10 and 11, as in FIG. 3 or the like, one transmission line is shown out of the two transmission lines constituting the transmission line pair.

Hereinabove, the description has been made on the principle in which the mutual inductance is reduced by the adoption of the transmission line of the present invention so that the crosstalk phenomenon is suppressed. Next, characteristics which are possessed by the transmission line of the present invention and not by the conventional transmission lines and which are advantageous for industrial use are explained in detail.

Figure 12:
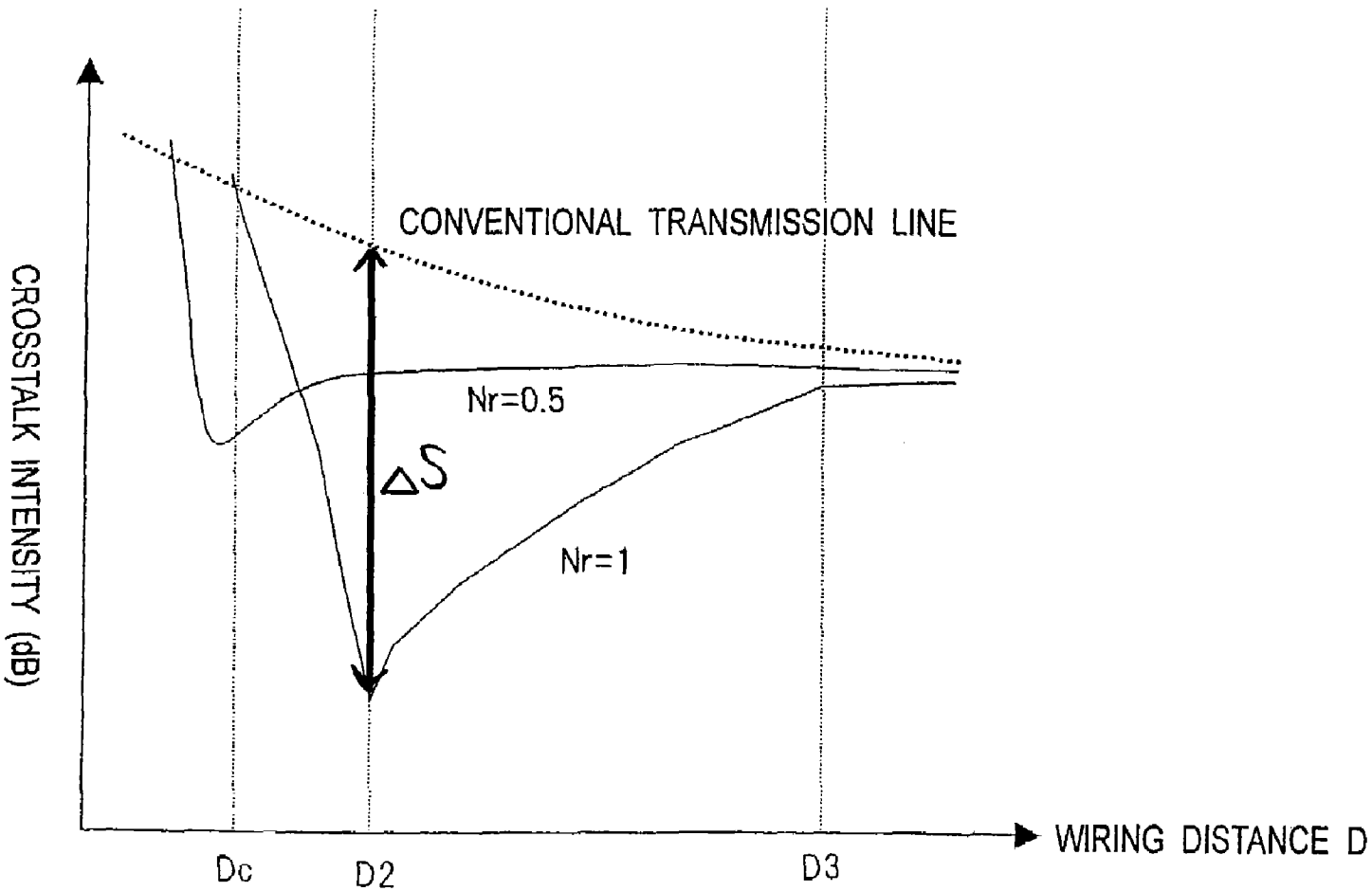
FIG. 12 is a schematic view in the form of a graph showing a comparison of wiring density dependence of crosstalk intensity among a transmission line pair which is an example of the present invention, a transmission line pair which is a comparative example, and a conventional transmission line pair.

In this description, first, a typical example of wiring distance D dependence of crosstalk characteristics between two adjacent transmission lines is schematically shown in FIG. 12 as a view in the form of a graph. In FIG. 12, as characteristics in the case where the transmission line pair of the present invention is adopted, a characteristic of a transmission line pair in which the number of rotations Nr of the rotational-direction reversal structure is 1 rotation (i.e., a structure including a transmission-direction reversal portion) as well as a characteristic of a transmission line pair in which the number of rotations Nr of the rotational-direction reversal structure is 0.5 rotation (i.e., a structure including no transmission-direction reversal portion) as a comparative example therefor are shown each by solid line, while a characteristic with the conventional linear transmission line pair adopted is shown by dotted line. Further, the characteristics shown in the figure are crosstalk characteristics at a particular frequency, for example, at 10 GHz. The wiring distance D is defined as a center-to-center distance of the total wiring formation regions as shown in FIG. 1, and the three examples in comparison are set to one identical wiring distances D. That is, the three examples compared in the figure are equal in the wire number density per unit width in the transmission line. Also, in the setting for the comparison, the local signal conductor width w in the transmission line pair of the present invention is so set that a signal conductor width w of the transmission line pair of the comparative example and the signal conductor width w in the example of the conventional transmission line are equal to each other, and the transmission line pairs are of equal effective characteristic impedance.

As shown in FIG. 12, in the conventional transmission line pair, the crosstalk amount increases as the wiring distance D is decreased. Therefore, with the conventional transmission line pair adopted, in order to obtain the crosstalk suppression effect of a specified value or higher, there is no way but increasing the wiring distance D to decrease the wiring density of the transmission lines. However, as the value of the wiring distance D is gradually decreased, the transmission line pair (number of rotations Nr=1 rotation) of the present invention starts to show crosstalk characteristics absolutely different from those of the conventional transmission line pair. That is, as the value of the wiring distance D becomes a specified wiring distance D3 or lower, the crosstalk amount starts to decrease significantly, going on improving toward a far more favorable value than the conventional transmission line pair. More specifically, in the transmission line pair of the present invention in which the number of rotations Nr of the rotational-direction reversal structure is 1 rotation, the crosstalk intensity takes a local minimum value when the wiring distance D=D2 (D2<D3), and a characteristic improvement amount ΔS over the conventional transmission line pair reaches a maximum. With the wiring distance D<D2, the crosstalk intensity starts to increase, but a far more favorable characteristic can still be achieved over the structure of the conventional transmission line pair. As the transmission lines become very closer to each other, the crosstalk suppression effect of the present invention is maintained until the wiring distance D=Dc, where the wiring region distance d comes close to 0, is reached. Under the condition that the wiring distance D=Dc, which is analytically determined, the wiring region distance d becomes such a low value as is impractical by actual process rules, so that the transmission line pair of the present invention produces a very industrially advantageous effect that successful isolation characteristics can be obtained at all times over the conventional transmission line pair on the assumed basis of practical process rules under the same wire number density.

Further, a preferable characteristic of the transmission line pair of the present invention is that D2, which is a value of the wiring distance D at which a minimum crosstalk intensity is achieved, has no frequency dependence. That is, the crosstalk intensity between adjacent transmission lines becomes a minimum value on condition that the wiring distance D=D2 normally at any frequency. Therefore, the transmission speed of signals treated within the equipment can be improved in the future such that the frequency of higher-frequency components contained in the signal is changed. Moreover, the advantageous effects of the present invention can be obtained continuously without the need for newly re-setting wiring rules.

Further, relationships among wiring distance D2, characteristic improvement amount ΔS and the structure of the transmission line pair of the present invention are explained qualitatively. In the case where the number of rotations Nr of the first signal conductor and the second signal conductor is as large as about 1 rotation, although the condition that the wiring distance D=D2 corresponds to a structure of a low wire number density, yet quite successful isolation characteristics can be obtained. Conversely, in the case where a structure of a small number of rotations Nr, e.g. a structure having the number of rotations Nr=0.5 rotation as in the transmission line pair of the comparative example, is adopted, although more successful isolation characteristics than in the conventional transmission line pair can be obtained under the condition that the wiring distance D=D2, the crosstalk intensity suppression amount becomes no longer as comparable to the transmission line pair of the present invention (a structure in which the number of rotations Nr=1 rotation). However, since the crosstalk amount can be brought to a local minimum value under the condition of a very high wiring density, there can be provided industrially significant effects in either case.

The above-described phenomenon that the crosstalk comes to a local minimum value can be attributed to an increase in mutual capacitance due to a decrease in the wiring region distance d in the transmission line pair of the present invention as compared with the conventional transmission line pair. As described in the background art, the crosstalk current corresponds to a difference between Ic due to the mutual capacitance and an induced current Ii due to the mutual inductance, where Ii>Ic in normal transmission line pairs. In the transmission line pair of the present invention, a structure in which the induced current Ii is decreased is adopted as described above, and moreover the total wiring region width W is larger than that of the conventional transmission line pair so that the wiring region distance d between adjacent transmission lines is decreased, by which Ic is effectively increased. As a result of this, with the wiring distance D=D2, Ii and Ic which are of inverse signs and equal intensity are canceled out by each other at the far-end side crosstalk terminal, thus making it possible to minimize the crosstalk signal intensity. Accordingly it holds that Ii<Ic with wiring distance D<D2, so that the crosstalk voltage at the far-end side crosstalk terminal comes to have a sign inverse to that of the case where the wiring distance D>D2.

Further, since the total wiring region width W in the transmission line pair of the present invention is increased over that of the conventional transmission line pair, it is physically impossible to set an extremely small value for the wiring distance D. For instance, if the total wiring region width W is set to five times the wiring width w, then the wiring distance D can no longer be set to not more than five times as large as w, whereas there can be obtained a result that values of the analytically determined wiring distance Dc are concentrated to about 5.2 times as large as the wiring width w even under changed conditions of the number of rotations Nr of the rotational structure of the signal conductors and the like. Furthermore, with the total wiring region width W set to 3 times as large as the wiring width w, an analytically determined wiring distance Dc is about 3.2 times as large as the wiring width w. That is, it can be considered that if the gap between the total wiring regions is maintained to ⅕ or more as large as the wiring width w, then the transmission line pair of the present invention is enabled to maintain more successful isolation than in the conventional transmission line pair.

Besides, normally, the wiring distance D3 is about two times as large as the total wiring region width W. Even with D>D3, although superior effects of the present invention over the case in which the conventional transmission line pair is adopted are reduced in degree, better characteristics are still obtained as compared with the conventional transmission line pair. That is, the transmission line pair of the present invention, except for the case where the wiring region distance d is significantly lowered, is capable of providing the advantageous effect that crosstalk is suppressed more than in the conventional transmission line pair under all the wiring density conditions.

Although more advantageous effects are obtained with increasing number of rotations Nr set in the rotational-direction reversal structure for the purposes of mutual inductance reduction and unwanted radiation suppression, yet the effects of the present invention may be lost when electrical lengths of the first signal conductor and the second signal conductor reach considerable line lengths with respect to the effective wavelength of the transmitted electromagnetic wave. Further, increases in the number of rotations Nr would cause increases also in the total wiring region width W, undesirable for area saving of the circuit. Also, increases in the total wiring length also could be a cause of signal delay. Moreover, since the effective wavelength of the electromagnetic wave becomes shorter at the upper limit of the transmission frequency band, setting the number of rotations to a high value would cause the wire lengths of the first signal conductor and the second signal conductor to approach the electromagnetic wavelength and therefore to approach the resonance condition as well, in which case reflection becomes more likely to occur and, as a result, the usable band for the transmission line pair of the present invention is limited, which is undesirable for practical use. Such unwanted reflection of signals would not only lead to intensity decreases or unwanted radiation of the transmitted signal, but also incur deteriorations of group delay frequency characteristics, which may lead to deterioration of the error rate for the system. Consequently, a practical setting upper limit for the number of rotations Nr for the first signal conductor and the second signal conductor is, preferably, 2 rotations or lower in general use.

Also, with the use of the transmission line pair of the present invention, it is considered that two types of issues exit in relation to group delay frequency characteristics. A first issue is an increase in the total delay amount, and a second is a delay dispersion issue that the delay amount increases with increasingly heightening frequency. The first issue, the increase in total delay amount, is a fundamentally unavoidable issue with the use of the transmission line pair of the present invention. However, the degree of increase in delay amount due to stretching of connecting wires in the transmission line pair of the present invention amounts to at most a few percent to several tens percent, as compared with conventional transmission line pairs, such that this level of increase in delay amount does not matter for practical use.

As to the second issue of the delay dispersion causing the delay amount to increase with increasingly heightening frequency of transmission band and causing the transmission pulse shape to collapse, this can easily be avoided. This is an issue which occurs when each site within the structure of the present invention reaches an electrical length that cannot be neglected with respect to the effective wavelength of the electromagnetic wave. Generally, for the transmission line structure of a planar radio-frequency circuit, a transmission line of the same equivalent impedance can be achieved by maintaining a ratio of line width to substrate thickness, and therefore, the total line width is reduced more and more as the substrate thickness is set increasingly thinner. Accordingly, the electrical length of each site also becomes negligible with respect to the effective wavelength, so that the issue of delay dispersion as the second issue can be solved without lessening the advantageous effects of the present invention.

Figure 13A:
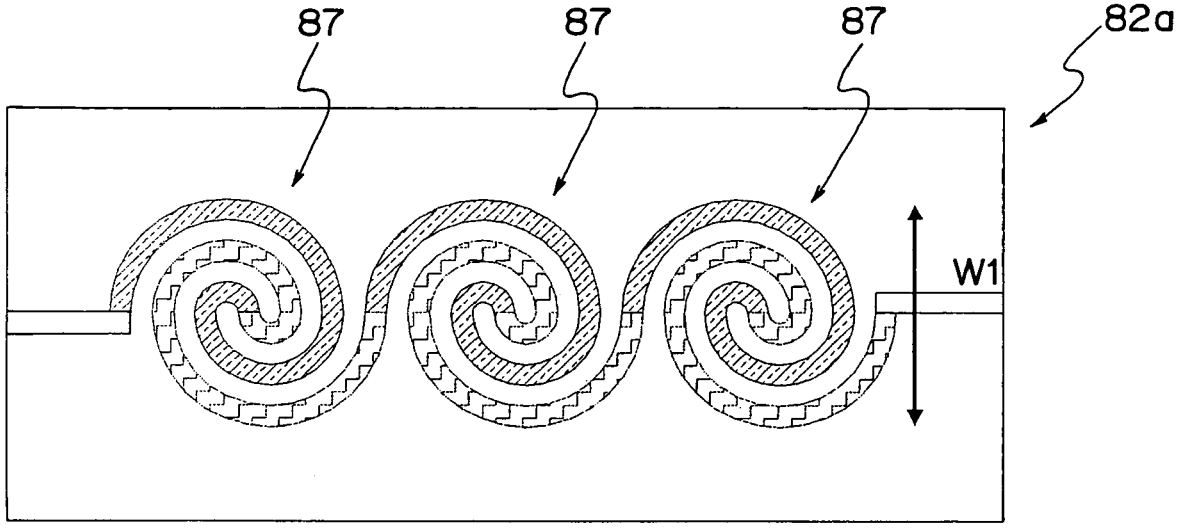
FIG. 13A is a schematic plan view showing one transmission line in the transmission line pair according to a modification of the foregoing embodiment, showing a structure in which the dielectric substrate is set thick.
Figure 13B:
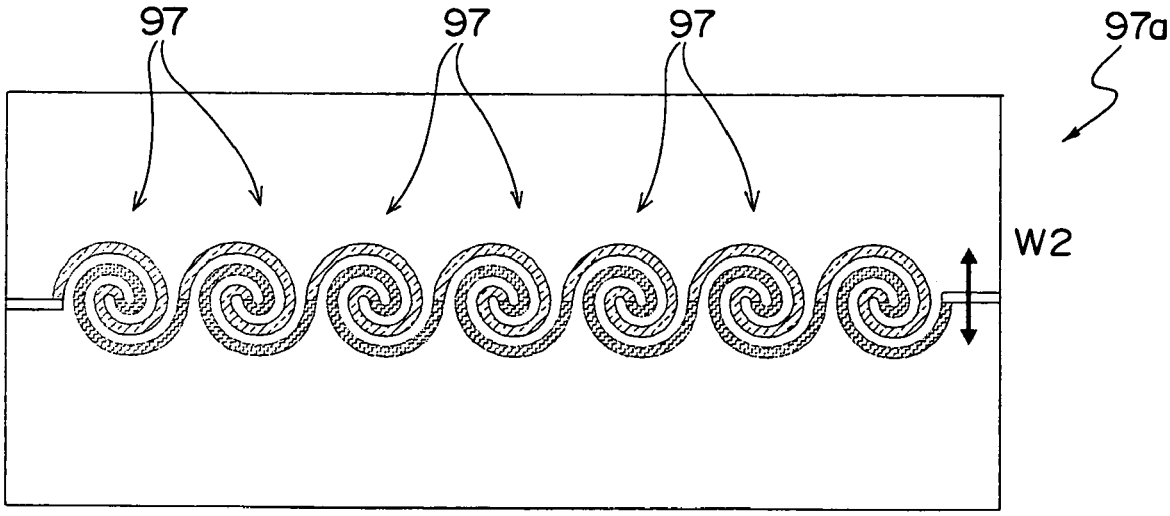
FIG. 13B is a schematic plan view showing a structure in which the dielectric substrate is set thinner as compared with the transmission line of FIG. 13A.

Now, as an example, a schematic plan view of a transmission line 82*a* in the case where the structure of the transmission line pair of the present invention is formed on a dielectric substrate having a large substrate thickness is shown in FIG. 13A, while a schematic plan view of a transmission line 97*a* in the case where the transmission line pair of the present invention is formed on a dielectric substrate having a small substrate thickness is shown in FIG. 13B, where a comparison is made between the two cases. It is noted that only one transmission line out of 2 transmission lines constituting a transmission line pair is shown in FIGS. 13A and 13B. In the transmission line 82*a* shown in FIG. 13A, since the total line width W1 is set large, each of the sites such as a rotational-direction reversal structure 87 becomes large. By contrast, in the transmission line 97*a* shown in FIG. 13B, since the total line width W2 (W2<W1) is set small due to a reduction in the circuit board thickness, it can be understood that the electrical length of each of the individual circuit-constituting sites such as the transmission-direction reversal structure 97 is reduced. This indicates that the more that trends move toward higher-density wiring that involves thinner circuit structures and finer wiring widths, the more the upper-limit frequency of the transmission band that can be managed by the transmission line pair structure of the present invention can be improved.

Next, an application example using the structure of the transmission line pair 10 according to this embodiment is explained below with reference to schematic plan views of transmission line pairs shown in FIGS. 14A and 14B.

Figure 14A:
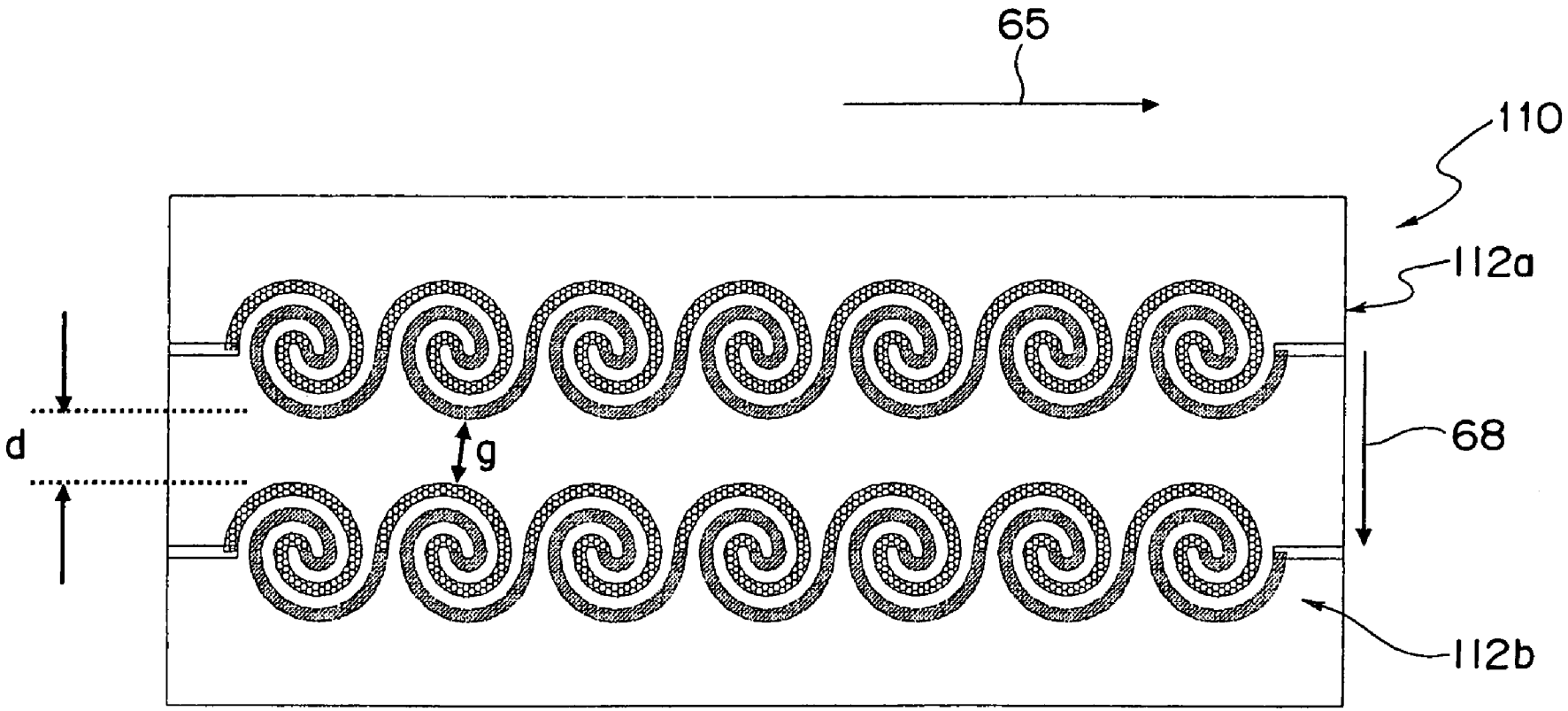
FIG. 14A is a schematic plan view showing a transmission line pair according to a modification of the foregoing embodiment, showing a structure in which the two transmission lines have a parallel translational placement relation.
Figure 14B:
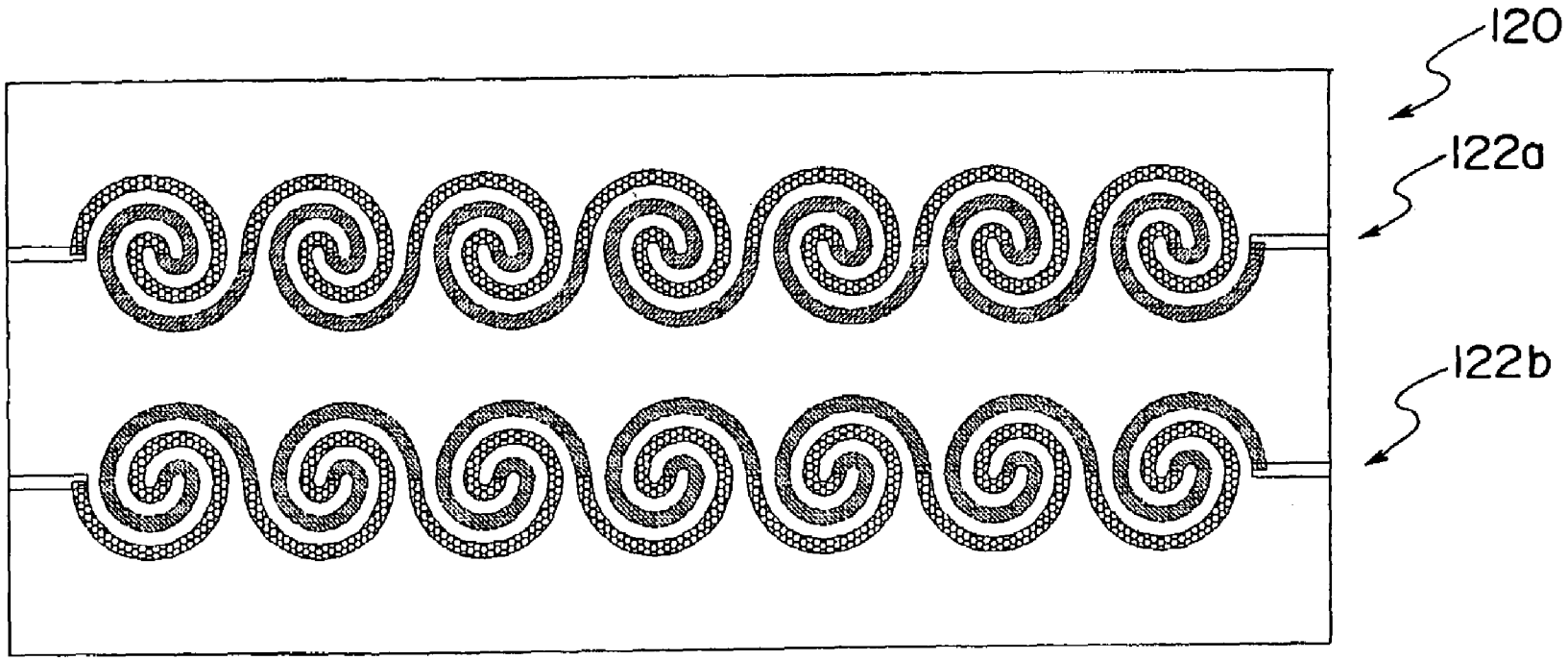
FIG. 14B is a schematic plan view showing a transmission line pair according to a modification of the foregoing embodiment, showing a structure in which the two transmission lines have a mirror-symmetry placement relation.

First, a transmission line pair 110 shown in FIG. 14A has a structure that two transmission lines 32*a* shown in FIG. 5 are used and placed in adjacency and parallel to each other. In such a transmission line pair 110, the transmission lines 112*a* and 112*b* can be made to function as single-end signal transmission paths, respectively, so that a transmission line pair (or transmission line group) with its line-to-line isolation maintained at a successful value can be realized.

In this case, as shown in FIG. 14A, the transmission line 112*b*, which is the adjacently placed counterpart of the transmission line 112*a*, is placed in such a relation that the transmission line 112*a* is translated in a direction 68 vertical to the signal transmission direction 65. Also, as shown in the transmission line pair 120 of FIG. 14B, two equivalent transmission lines 122*a* and 122*b* may be placed in mirror symmetry.

Figure 15:
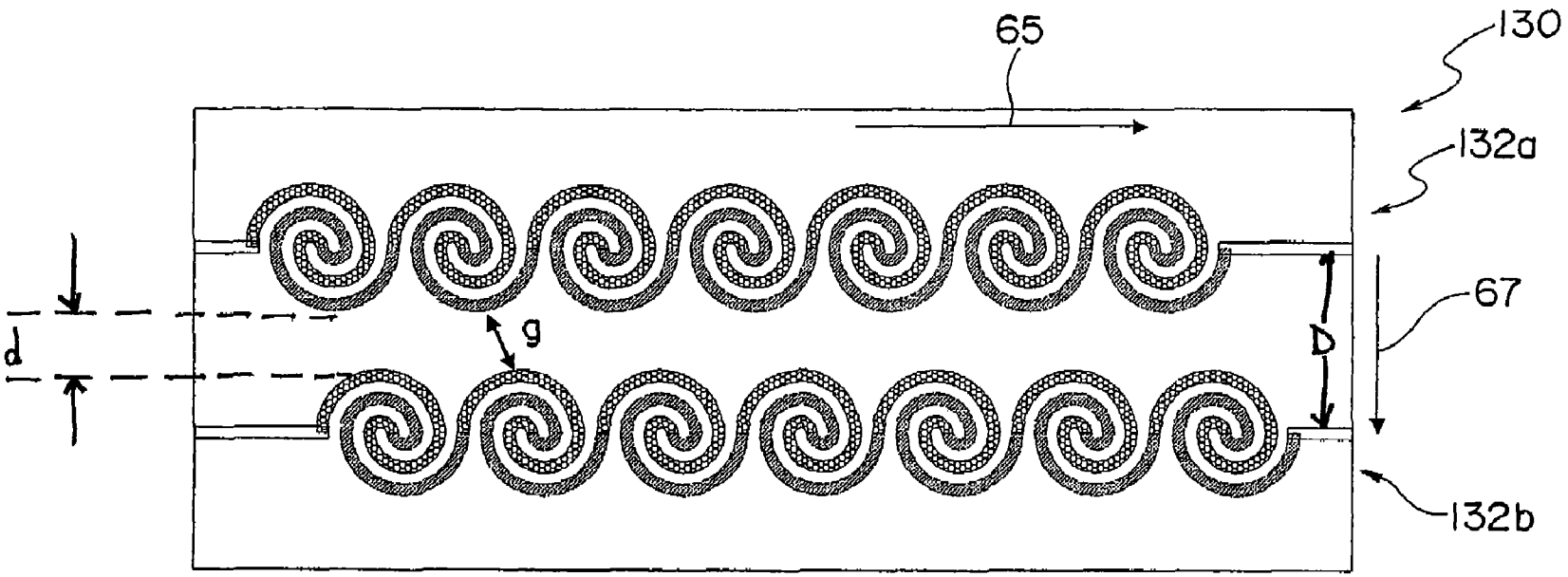
FIG. 15 is a schematic plan view showing a transmission line pair according to a modification of the foregoing embodiment, showing a structure in which the two transmission lines have a placement relation that one transmission line is translated along the signal transmission direction further than in the structure of FIG. 14A.

Further, more preferably, like a transmission line pair 130 shown in a schematic plan view of FIG. 15, a transmission line 132*b*, which is an adjacently placed counterpart of a transmission line 132*a*, is placed in a placement relation obtained by translating the transmission line 132*a* by a first translation along the direction 67 vertical to the signal transmission direction 65 and then by a second translation parallel to the signal transmission direction 65. Also, although not shown, such a relation is also preferable that only one of transmission lines of mirror symmetry is translated further in the signal transmission direction 65. An optimum move distance for the second translation is one half of the cycle of a plurality of rotational-direction reversal structures in the two transmission lines.

As apparent also from the comparison between the transmission line pair 110 of FIG. 14A and the transmission line pair 130 of FIG. 15, only by the first translation, the wiring region distance d between the transmission line 112*a* and the transmission line 112*b* results in an extremely small value and moreover the local shortest wiring distance g between the two transmission lines results also in a small value. Therefore, it can be considered that mutual capacitance between the two transmission line pairs is increased and, as a result, the crosstalk intensity suppression effect is decreased. On the other hand, when the second translation parallel to the signal transmission direction is further performed in addition to the first translation as shown in the transmission line pair 130 of FIG. 15, it becomes possible to expand the local shortest wiring distance g between the wires even with the wiring region distance d between the transmission line 132*a* and the transmission line 132*b* kept unchanged, the mutual capacitance between the two transmission lines is reduced. Thus, the wiring distance D between the two transmission lines needs to be further reduced in order to obtain a mutual capacitance having an intensity necessary for cancellation with the mutual inductance. As a result, the second translation makes it possible to produce an advantageous effect that the isolation can be maintained and moreover the wire number density can be improved, hence preferable.

In either case, given a wiring width w, a total wiring region width W and a wiring region distance d of the transmission line 112*a*, 122*a*, 132*a* and the transmission line 112*b*, 122*b*, 132*b*, it is a preferable condition that d is set within a range of ⅕ time as large as w to 1 time as large as W, and more preferably that d is set within a range of ½ as large as w to 0.6 time as large as W. Within these ranges, the isolation between the transmission lines in the transmission line pair (transmission line group) of the invention becomes most favorable values.

Figure 16:
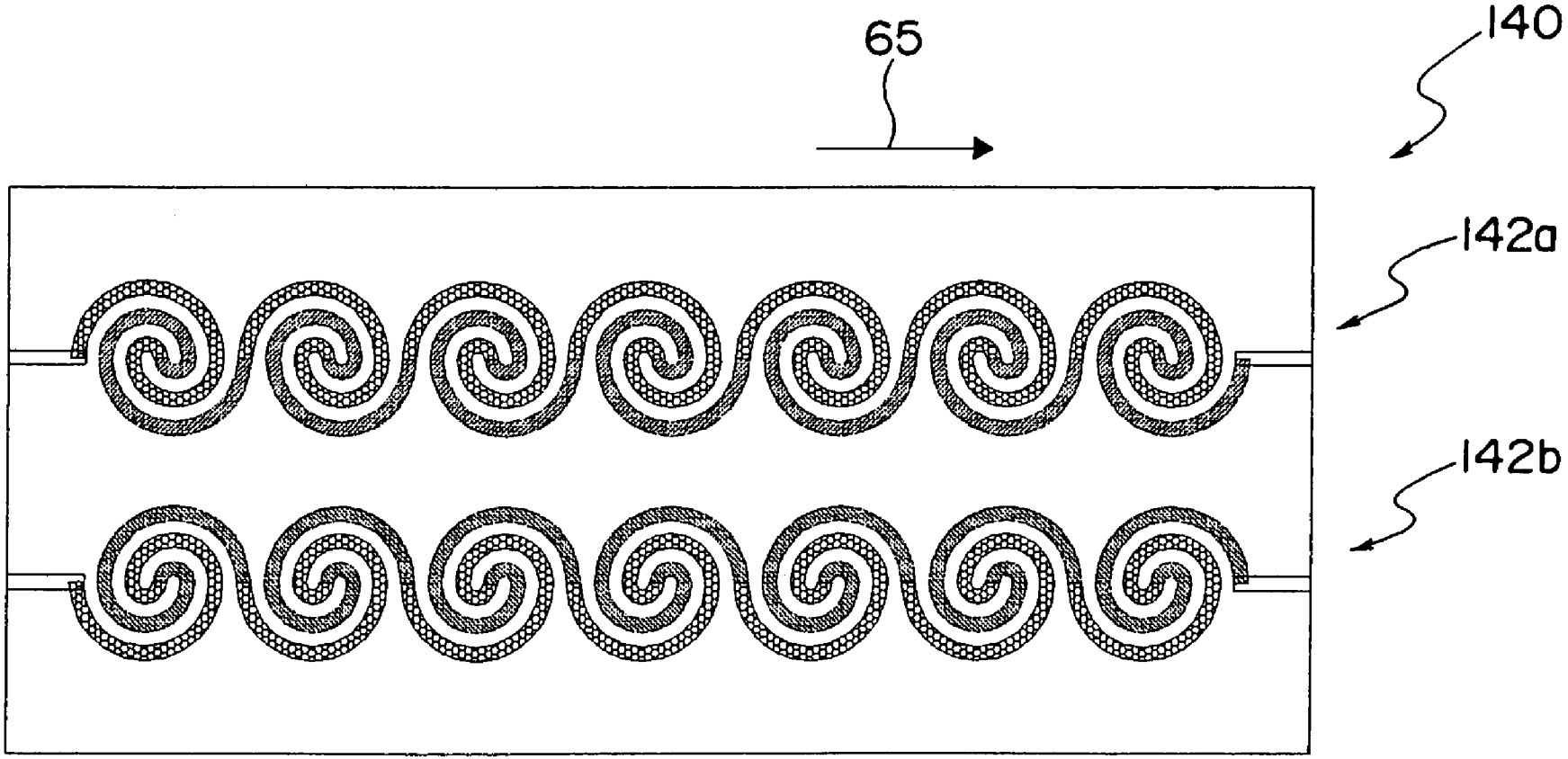
FIG. 16 is a schematic plan view showing a transmission line pair according to a modification of the foregoing embodiment, showing a structure for use as differential transmission lines.

Further, in the case where the transmission line pair of the present invention is used as a transmission path for differential signals, as shown in a schematic plan view of FIG. 16, a transmission line 142*b* which is paired with a transmission line 142*a* to form a differential transmission line pair 140 is preferably placed in mirror symmetry with respect to a plane parallel to the signal transmission direction 65. Since a differential signal is transmitted under support by the odd mode of the differential transmission line, a mirror-symmetry placement of the circuit is effective in order to avoid an unnecessary mode change from the odd to the even mode. In comparison with conventional transmission line pairs, when the transmission line pair structure of the present invention having an advantageous characteristic of non-radiativity during the single-end signal transmission is used as a differential transmission line, there can be obtained an advantageous effect of radiation characteristic improvement in the case where a common mode signal is superimposed on the differential transmission line. An advantageous effect of maintained isolation against peripheral differential transmission lines can also be obtained.

Figure 32A:
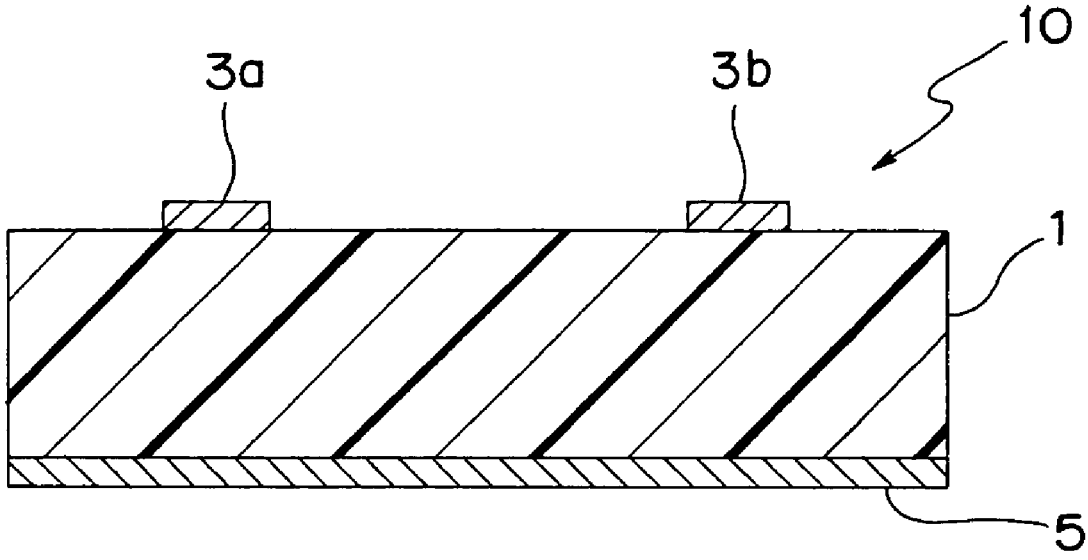
FIG. 32A is a schematic sectional view of a transmission line pair of the foregoing embodiment, showing a structure in which two signal conductors are placed in one identical plane.
Figure 32B:
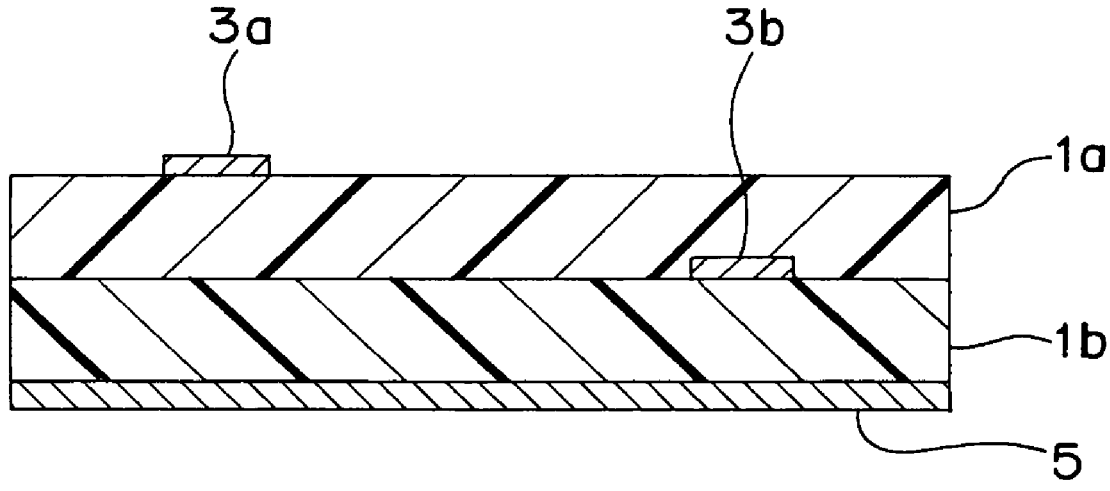
FIG. 32B is a schematic sectional view of a transmission line pair according to a modification of the foregoing embodiment, showing a structure in which two signal conductors are placed in different planes.

The above description has been made on a case where the two signal conductors 3*a* and 3*b* in the transmission line pair 10 of this embodiment are formed, for example, on a top face of the dielectric substrate, i.e. within one identical plane, as shown in a schematic sectional view of FIG. 32A. However, the transmission line pair of this embodiment is not limited to such a case only. Instead of such a case, for example, as shown in a schematic sectional view of FIG. 32B, the case may be that the dielectric substrate is a multilayer-structure substrate in which a first substrate 1*a* and a second substrate 1*b* are stacked one on another, where one signal conductor 3*a* is formed on the upper face of the first substrate 1*a* while the other signal conductor 3*b* is formed on the upper face of the second substrate 1*b*, as viewed in the figure, that is, two signal conductors are not placed on one identical plane but placed on different planes.

WORKING EXAMPLES

Next, several working examples of the transmission line (or transmission line pair) of this embodiment will be described below.

First, as a working example of this embodiment and a comparative example against this working example, a signal conductor having a thickness of 20 μm and a width of 100 μm was formed by copper wire on a top face of a dielectric substrate having a dielectric constant of 3.8 and a total thickness of 250 μm, and a grounding conductor layer having a thickness of 20 μm was formed on a rear face of the dielectric substrate similarly by copper wire, by which a microstrip line structure was made up. A comparison was made with the coupled line length Lcp uniformly set to 5 mm for measurement of crosstalk intensity. An input terminal was connected to a coaxial connector, and an output-side terminal was terminated for grounding with a resistor of 100 Ω, which is a resistance value nearly equal to the characteristic impedance, so that any adverse effects of signal reflection at terminals were reduced. With the total wiring region width W set to 500 μm, the first signal conductor and the second signal conductor were formed so as to be curved with a number of rotations Nr within the rotational-direction reversal structure. Characteristics of the transmission line pairs according to such working example and comparative example as described above were compared with characteristics of Prior Art Example 1, which is a linear-type conventional transmission line pair. In comparisons of characteristics among two or more types of transmission lines, substrate conditions, wiring length Lcp, wiring width w and wiring distance D were set uniform in all cases.

More concretely, the transmission line pair of Comparative Example 1 was so structured that the number of rotations Nr corresponded to 0.5, hence the transmission line pair having a rotational-direction reversal structure but not having any transmission-direction reversal portion, and that signal conductors each having a semicircular-arc shape with an outer diameter of 250 μm and an inner diameter of 150 μm were connected one another in 9 cycles so as to be curved in mutually different rotational directions. That the wiring distance D=750 μm corresponds to a length which is 1.5 times as large as the total wiring region width W and 7.5 times as large as the wiring width w. The structure of the transmission line pair of Comparative Example 1 was obtained by substituting the transmission lines of the above-described structure for the linear-shaped transmission lines in the two lines (i.e. transmission line pair) of the structure of the transmission line pair of Prior Art Example 1. The two transmission lines, which were of the same configuration and size, were in such a relation that one transmission line was shifted by 750 μm in a direction vertical to the signal transmission direction. Furthermore, a transmission line pair of Comparative Example 2 having a placement relation of mirror symmetry between one transmission line and the other transmission line without changing the wiring distance D was fabricated as well.

Figure 17:
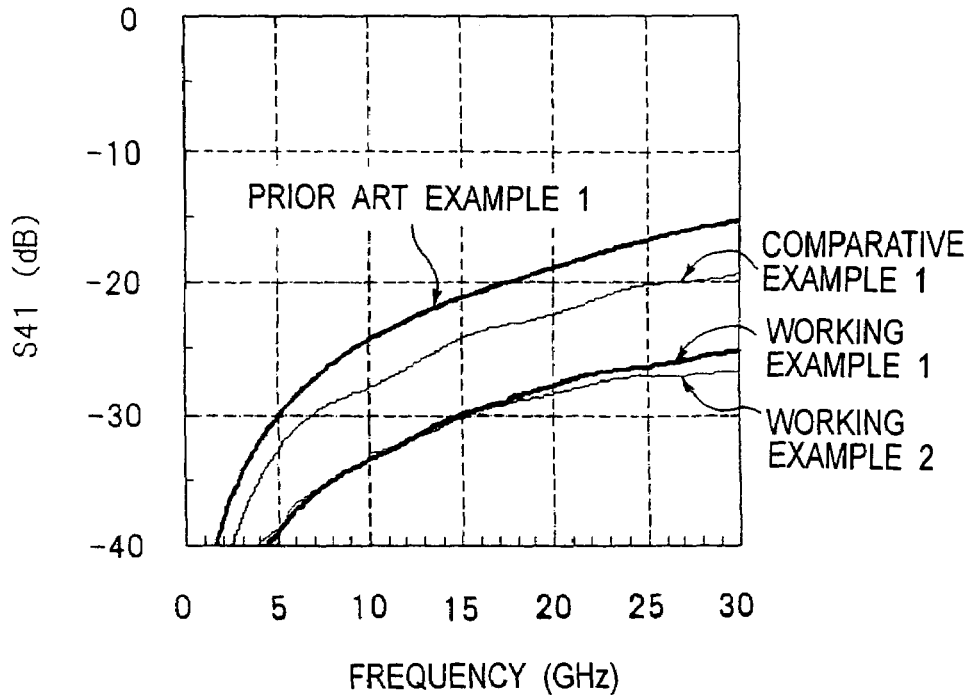
FIG. 17 is a view showing the frequency dependence of isolation characteristics in the transmission line pairs of Working Examples 1 and 2 of the embodiment, as well as in the transmission line pair of Comparative Example 1 and the transmission line pair of Prior Art Example 1 against those Working Examples.

FIG. 17 shows a comparison of crosstalk characteristics between the transmission line pair of Comparative Example 1 and the transmission line pair of Prior Art Example 1. It is noted that in FIG. 17, the vertical axis represents crosstalk characteristic S41 (dB) and the horizontal axis represents frequency (GHz). As apparent from FIG. 17, the transmission line pair of Comparative Example 1 yielded a more successful isolation characteristic than the transmission line pair of Prior Art Example 1 over the entire frequency band (to 30 GHz) of measurement. For instance, whereas Prior Art Example 1 was incapable of keeping the crosstalk intensity below 25 dB at a frequency band of 10 GHz or higher, Comparative Example 1 was able to suppress the crosstalk intensity below 20 dB at the frequency band of 25 GHz or lower.

Also, the transmission line pair of Working Example 2 was able to fulfill a crosstalk intensity characteristic of 20 dB or lower at the frequency band of 23 GHz or lower, which is a value nearly equivalent to that of Working Example 1. Comparative Example 1-2, in which only one of the two transmission lines that had been parallel to each other in Comparative Example 1 was shifted by 250 μm along the signal transmission direction, was capable of keeping low crosstalk characteristics of 20 dB or lower at the frequency band of 32 GHz or lower. It is noted that the move distance of 250 μm corresponds to one half of the cycle of rotational-direction reversal structures. Moreover, transmission line pairs in which the number of iterations of rotational-direction reversal structures that had been placed in series iteratively to 9 times in Comparative Example 1 was lessened to 5 and 1, although having showed reduced effects, were also able to obtain more favorable isolation characteristics than in Prior Art Example 1 over the entire frequency band, similarly.

Figure 18:
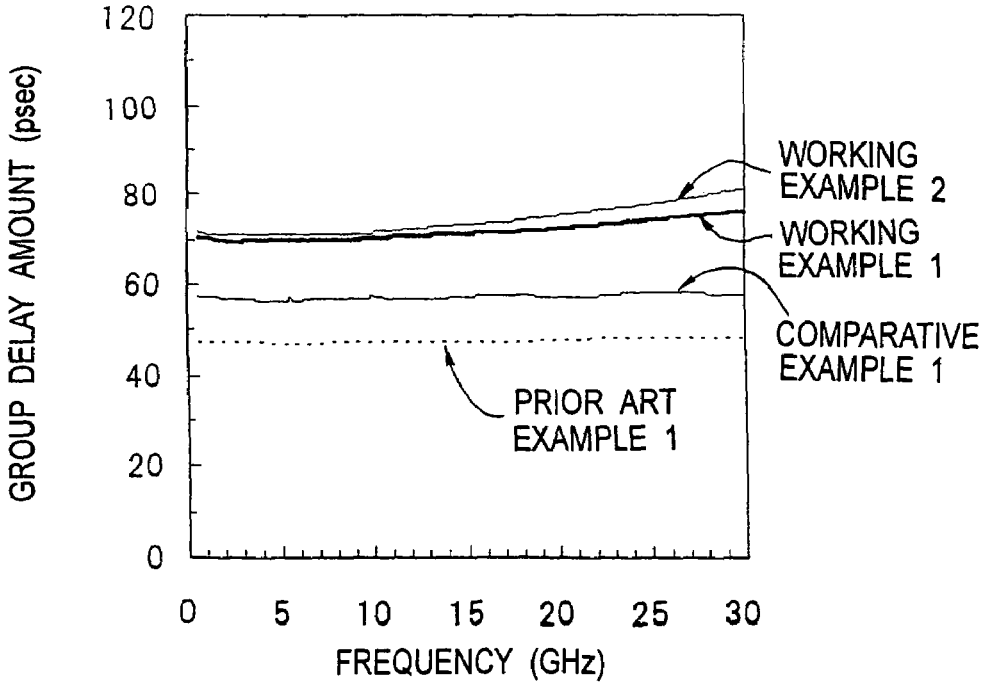
FIG. 18 is a view showing the frequency dependence of transit group delay frequency characteristics in the transmission line pairs of Working Examples 1 and 2 and Comparative Example 1 as well as the transmission line pair of Prior Art Example 1.

A comparison of group delay frequency characteristics between Prior Art Example 1 and Comparative Example 1 is shown in FIG. 18. In FIG. 18, the vertical axis represents group delay amount (in picoseconds) and the horizontal axis represents frequency (GHz). The delay amount that had been 48 picoseconds in Prior Art Example 1 showed an increase of about 20% in Comparative Example 1, but this level of increase in delay amount can be said to be within a negligible range.

Next, as transmission line pairs of Working Examples 1 and 2 which are working examples of this embodiment, transmission lines in which the number of rotations Nr of rotational-direction reversal structures that had been 0.5 in Comparative Examples 1 and 2 was increased to 0.75 and 1 as the numbers of rotations Nr of the signal conductors rotation, respectively, were placed in parallel to each other, each two in number, and subjected to measurement of forward crosstalk intensity from one transmission line to another transmission line as well as transit intensity characteristic. That is, in contrast to Comparative Examples 1 and 2, which are structured so as to have the rotational-direction reversal structures but not to have the transmission-direction reversal portion, Working Examples 1 and 2 were provided so as to have both the rotational-direction reversal structures and the transmission-direction reversal portion. The signal conductors were made to have a total wiring width of 500 μm or less. More specifically, the value of w was decreased from 100 μm of Comparative Example 1 to 75 μm to make up the rotational-direction reversal structure. The transmission lines constituting Working Example 1 (Nr=0.75) and 2 (Nr=1) had effective characteristic impedances corresponding to 102 Ω and 105 Ω, respectively, with the terminal impedance in measurement set to 100 Ω. The rotational-direction reversal structures were placed in continuation of 8 cycles in Working Example 1 and of 7 cycles in Working Example 2. In FIG. 17, frequency dependence of crosstalk characteristics in Working Examples 1 and 2 were added in addition to characteristics of Comparative Example 1 and Prior Art Example 1. As apparent from FIG. 17, the crosstalk intensity suppression effect was further improved in Working Examples 1 and 2, in which the number of rotations was increased over Comparative Example 1.

Also, in FIG. 18, frequency dependence of group delay frequency characteristics in Working Examples 1 and 2 were added in addition to transit group delay frequency characteristics of Comparative Example 1 and Prior Art Example 1. As apparent from FIG. 18, the delay amount increased with increasing number of rotations, but the increase in delay amount of Working Example 1 (Nr=0.75) as an example was as small an increase as 45% as compared with Prior Art Example 1, which was of a level that does not matter for practical use. From the individual Working Examples shown above, it was able to be demonstrated that the transmission line pair of the present invention imparts totally favorable characteristics to the radio-frequency circuit even in cases where the number of rotations is changed.

Figure 19:
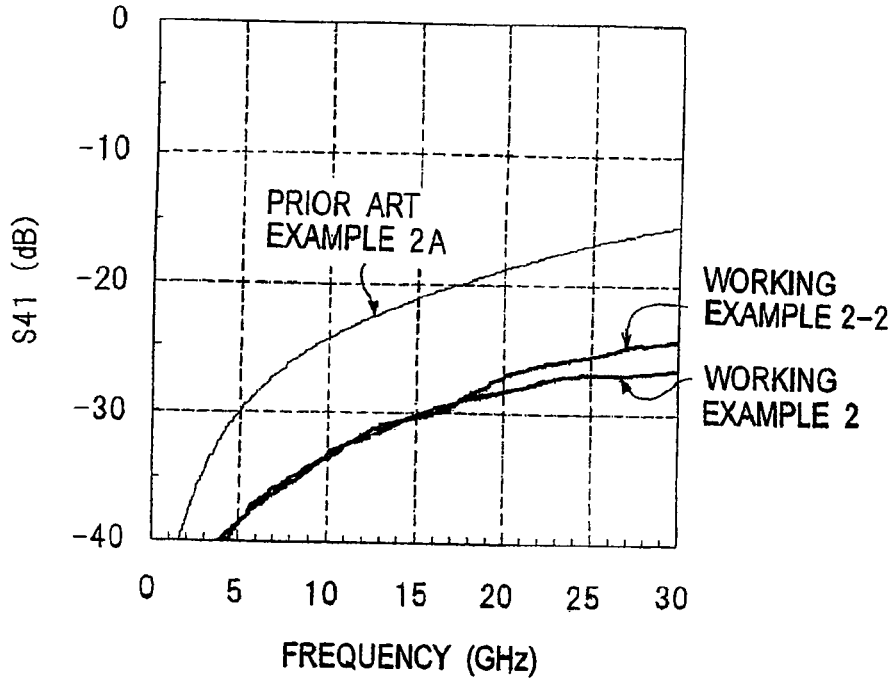
FIG. 19 is a view showing the frequency dependence of isolation characteristics in the transmission line pairs of Working Examples 2 and 2-2 and the transmission line pair of Prior Art Example 2A.
Figure 20:
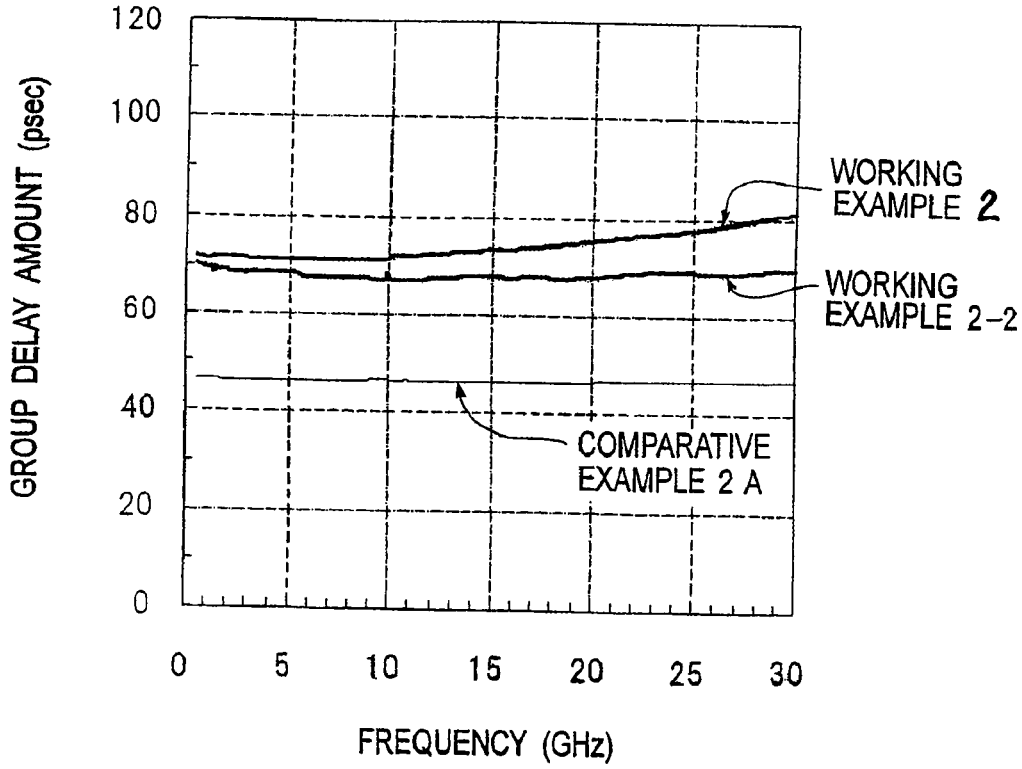
FIG. 20 is a view showing the frequency dependence of transit group delay frequency characteristics in the transmission line pairs of Working Examples 2 and 2-2 and the transmission line pair of Prior Art Example 2A.

Next, a transmission line pair structure in which the circuit construction of the transmission line pair of Working Example 2 was reduced to one half was assumed as a transmission line of Working Example 2-2 and subjected to measurement of characteristics of the transmission line pair structure. More specifically, the individual parameters were lessened to one half as compared with Working Example 2, including substrate thickness (125 μm), total wiring width (250 μm), wiring width w (37.5 μm) and wire-to-wire distance D (375 μm). However, the thickness of copper wire was unchanged as 20 μm and the wire length was also held as it was 5 mm. The number of iterations of rotational-direction reversal structures reached 14 times, which is double that of Working Example 2. A comparison of crosstalk characteristics (S41) between Working Example 2 and Working Example 2-2 is shown in FIG. 19, and a comparison of group delay frequency characteristics is shown in FIG. 20. In each of FIGS. 19 and 20, a characteristic of Prior Art Example 2A made up from two microstrip lines each having a substrate thickness of 125 μm, a total wiring width of 250 μm and a wire-to-wire distance of 375 μm was shown in addition.

As shown in FIG. 19, although the crosstalk suppression effect slightly decreased due to structural reduction, far more favorable characteristics were able to be obtained over the entire band in comparison with Prior Art Example 2A of conventional transmission line pair characteristics at the same scale. Also, as shown in FIG. 20, the issue that the group delay frequency characteristics deteriorated with increasingly heightening frequency in Working Example 2 was able to be improved in Working Example 2-2 in which the substrate thickness was lessened and the effective line lengths of the first signal conductor and the second signal conductor were shortened.

Figure 21A:
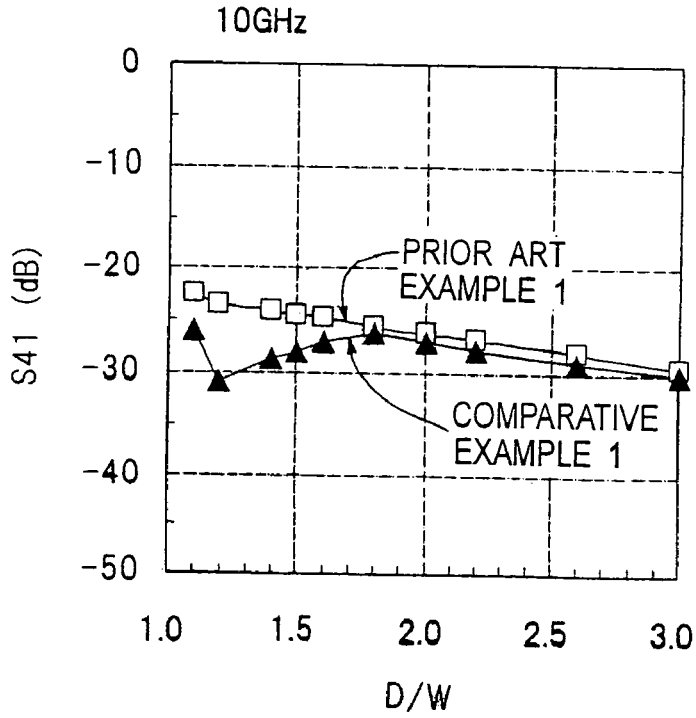
FIG. 21A is a view showing the wiring distance D dependence (with a frequency of 10 GHz) of crosstalk intensity in the transmission line pair of Comparative Example 1 and the transmission line pair of Prior Art Example 1.
Figure 21B:
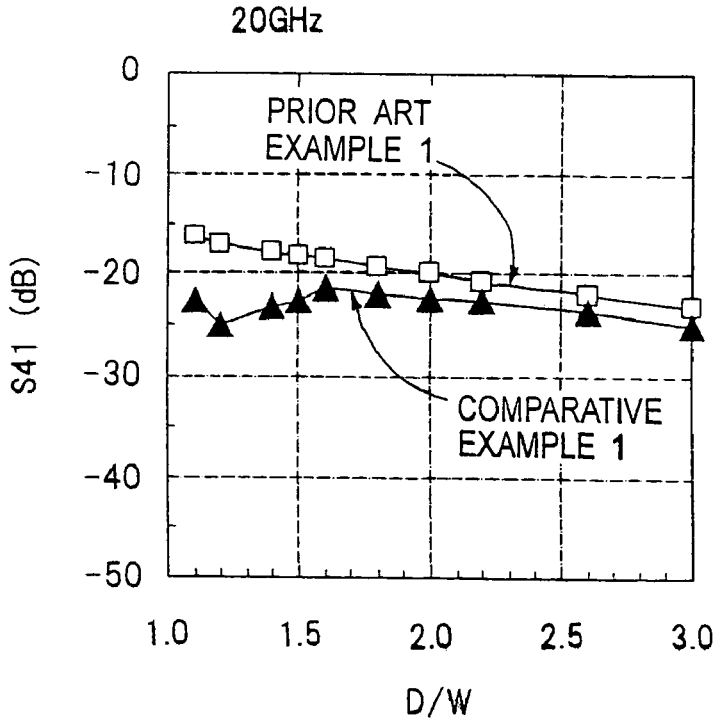
FIG. 21B is a view showing the wiring distance D dependence (with a frequency of 20 GHz) of crosstalk intensity in the transmission line pair of Comparative Example 1 and the transmission line pair of Prior Art Example 1.

Furthermore, with respect to Comparative Example 1 and Working Example 2, comparative examples and working examples of increased and decreased wiring distances D between adjacent transmission lines, as well as prior art examples of increased and decreased wiring distances D in comparison with Prior Art Example 1, were fabricated as well. Referring first to a comparison between Comparative Example 1 and Prior Art Example 1, Comparative Example 1 showed a successful crosstalk suppression effect at all times over Prior Art Example 1 with the wiring distance D set to the identical conditions. FIGS. 21A and 21B show wiring distance D dependence of the crosstalk intensity in Prior Art Example 1 and Comparative Example 1 at frequencies of 10 GHz and 20 GHz. It is noted that in FIGS. 21A and 21B, the horizontal axis show values of the wiring distance D normalized by the total wiring region width W. Also, although it holds that w=W in the transmission line of Prior Art Example 1, yet a value of 500 μm of the transmission line of the invention was used to calculate values of D/W for the sake of calculation.

As apparent from FIGS. 21A and 21B, even at different frequencies, local minimum values of crosstalk were obtained at one identical D value. Also, even if the wiring distance was decreased to 1.1 times as large as W (where the wiring region distance d corresponds to one half of w), the crosstalk characteristic of Comparative Example 1 surpassed the characteristic of the conventional transmission line pair. In analytical results, even a value of d decreased to ⅕ of w in Comparative Example 1 resulted in a crosstalk intensity lower than that of the conventional transmission line pair under the same conditions.

Figure 22A:
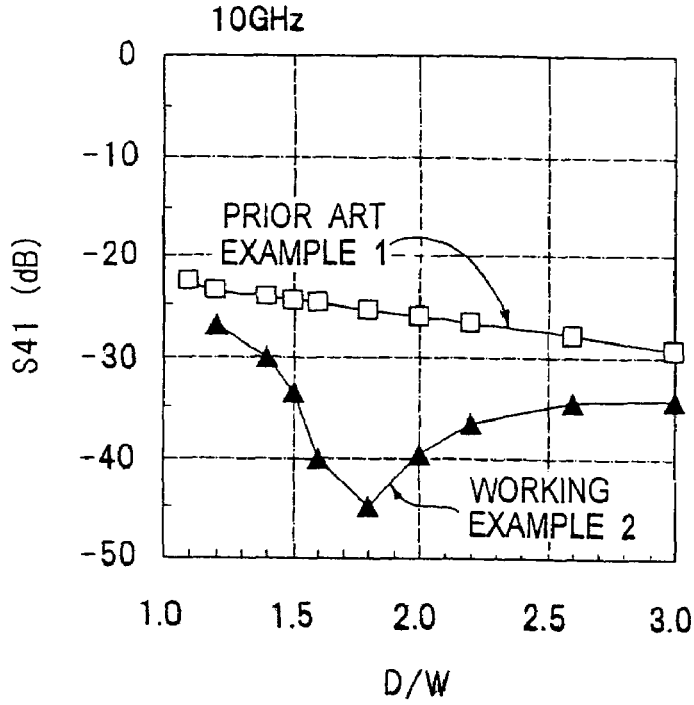
FIG. 22A is a view showing the wiring distance D dependence (with a frequency of 10 GHz) of crosstalk intensity in the transmission line pair of Working Example 2 and the transmission line pair of Prior Art Example 1.
Figure 22B:
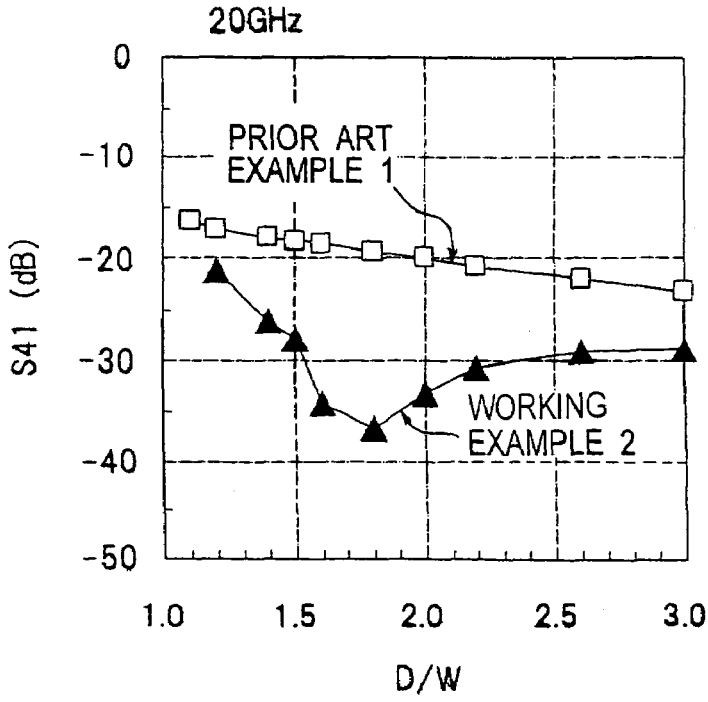
FIG. 22B is a view showing the wiring distance D dependence (with a frequency of 20 GHz) of crosstalk intensity in the transmission line pair of Working Example 2 and the transmission line pair of Prior Art Example 1.

Next, a comparison between Working Example 2 and Prior Art Example 1 is explained. For this explanation, FIGS. 22A and 22B show wiring distance D dependence of the crosstalk intensity in Prior Art Example 1 and Working Example 2 at frequencies of 10 GHz and 20 GHz. As apparent from FIGS. 22A and 22B, also in Working Example 2, as in Comparative Example 1, not only local minimum values of crosstalk were able to be obtained at D=1.8×W, which was a value of D independent of frequency, but also crosstalk suppression effects over Comparative Example 1 were obtained. Also, even if the wiring distance was decreased to 1.1 times as large as W (where the wiring region distance d corresponds to one half of w), the crosstalk characteristic (S41) of Working Example 2 surpassed the characteristic of the conventional transmission line pair. Further, in analytical results, even a value of d decreased to ⅕ of w in Working Example 2 resulted in a crosstalk intensity lower than that of the conventional transmission line pair under the same conditions. Furthermore, in either case, even if the wiring distance D was set to a value 3 times or more as large as the total wiring region width W, characteristics higher than the crosstalk characteristics of Prior Art Example 1 were able to be obtained.

Figure 23A:
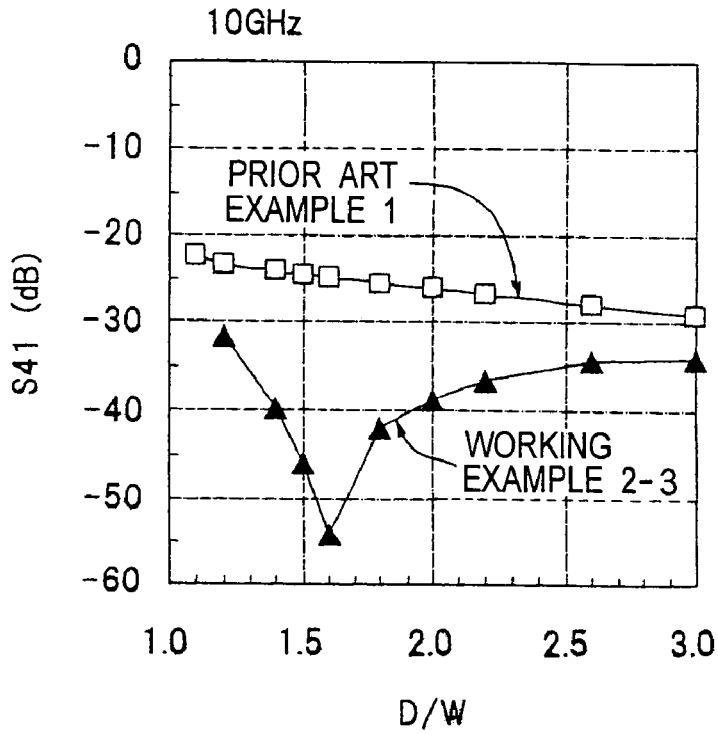
FIG. 23A is a view showing the wiring distance D dependence (with a frequency of 10 GHz) of crosstalk intensity in the transmission line pairs of Working Examples 2-3 and the transmission line pair of Prior Art Example 1.
Figure 23B:
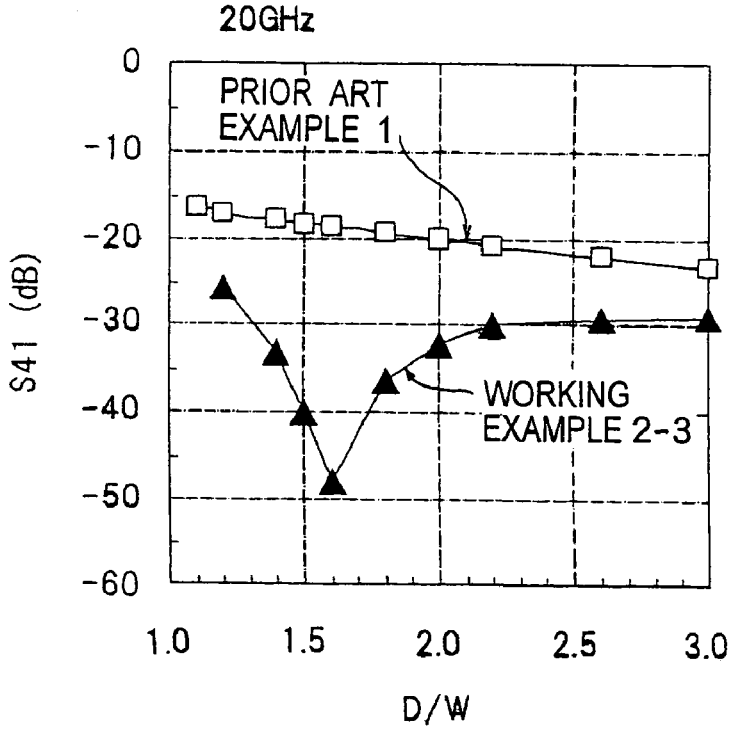
FIG. 23B is a view showing the wiring distance D dependence (with a frequency of 20 GHz) of crosstalk intensity in the transmission line pair of Working Examples 2-3 and the transmission line pair of Prior Art Example 1.

Further, FIGS. 23A and 23B show wiring distance D dependence of crosstalk characteristics (S41) in Working Example 2-3 in which one of the adjacent transmission lines that had been placed in parallel to each other in Working Example 2 was shifted by 250 μm along the signal transmission direction. In Working Example 2-3, not only local minimum values of crosstalk were able to be obtained at D=1.6×W, which was a higher-density wiring condition than in Working Example 2, but also crosstalk suppression effects over Working Example 2 were obtained.

Figure 24:
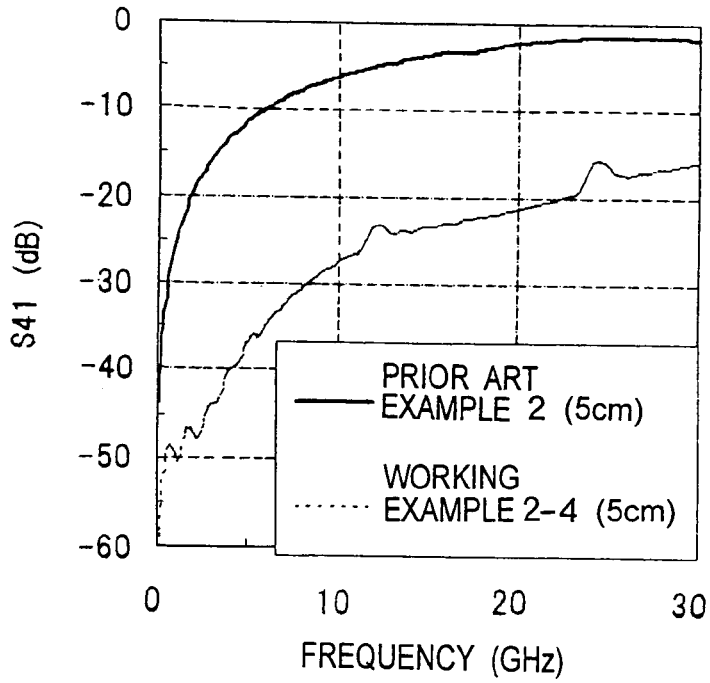
FIG. 24 is a view showing the frequency dependence of crosstalk intensity in the transmission line pair of Working Example 2-4 and the transmission line pair of Prior Art Example 2.
Figure 25:
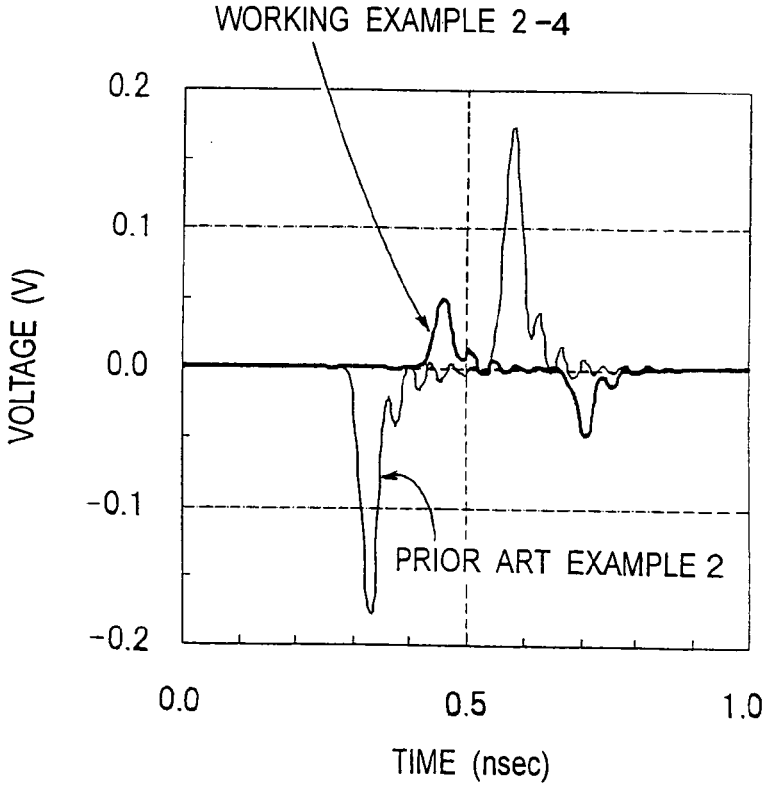
FIG. 25 is a view showing crosstalk voltage waveforms observed at the far-end crosstalk terminal upon application of a pulse to the transmission line pair of Working Example 2-4 and the transmission line pair of Prior Art Example 2.
Figure 26A:
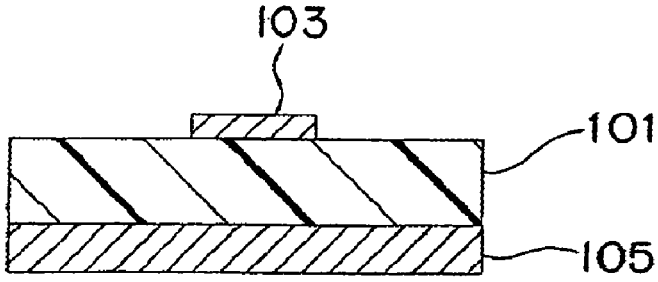
FIG. 26A is a view showing a transmission line cross-sectional structure of a conventional transmission line in the case of single-end transmission.
Figure 26B:
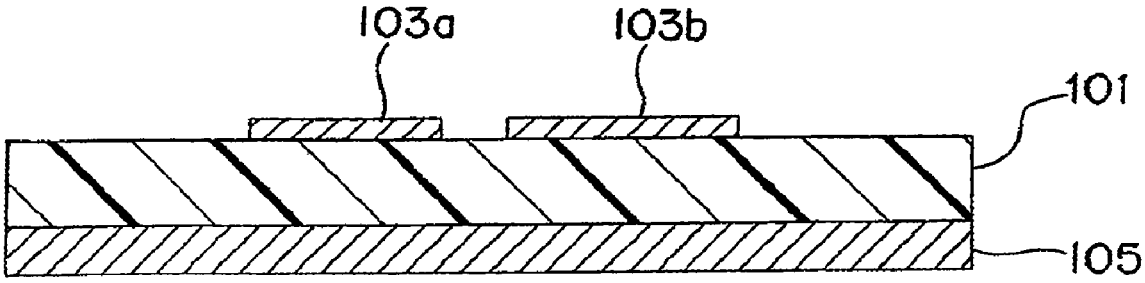
FIG. 26B is a view showing a transmission line cross-sectional structure of a conventional transmission line pair in the case of differential signal transmission.
Figure 27A:
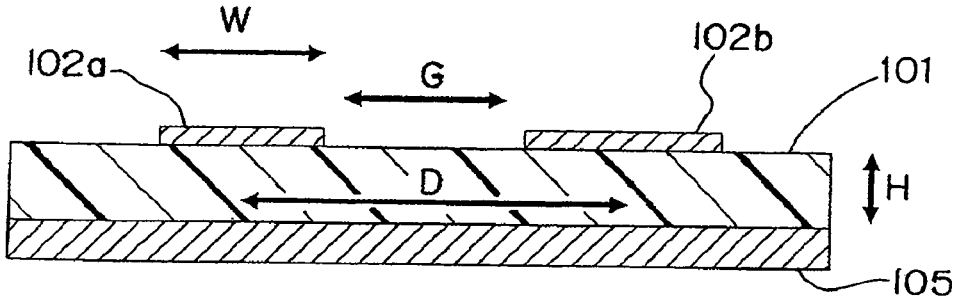
FIG. 27A is a schematic sectional view of a conventional transmission line pair.
Figure 27B:
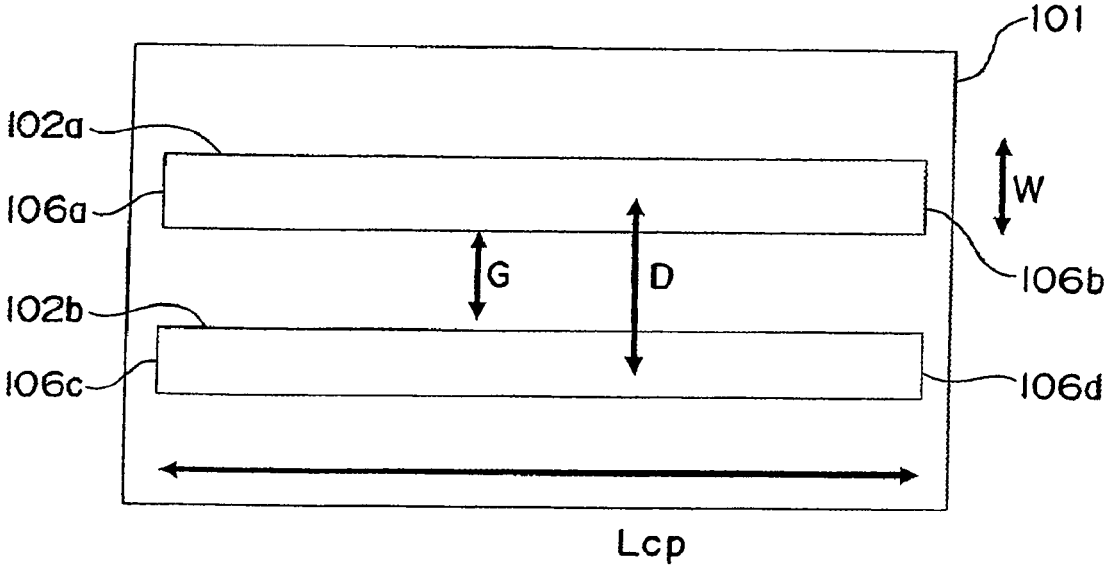
FIG. 27B is a schematic plan view of the conventional transmission line pair of FIG. 27A.
Figure 31:
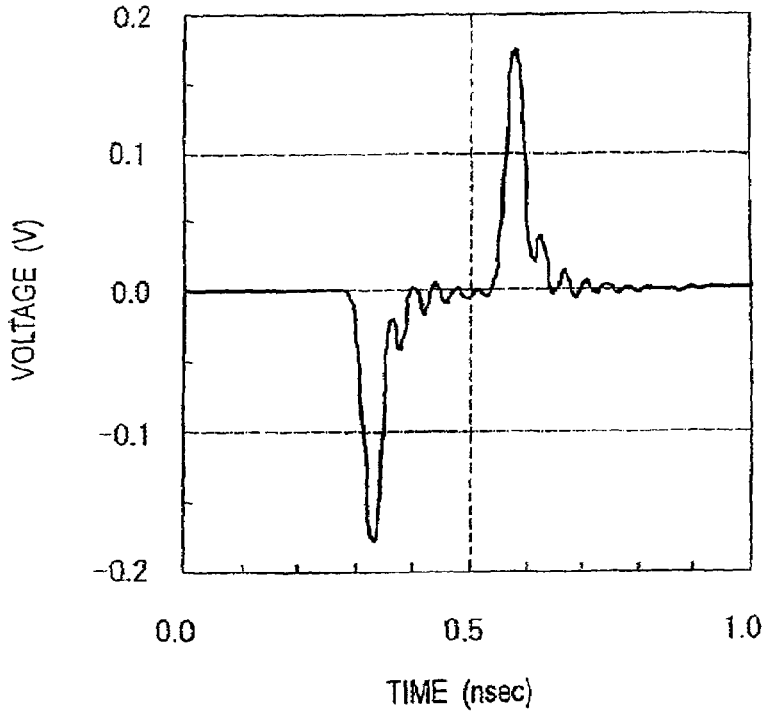
FIG. 31 is a view showing a crosstalk voltage waveform observed at the far-end crosstalk terminal upon application of a pulse to the transmission line pair of Prior Art Example 2.

Also, Working Example 2-4 in which the wiring distance D was set to 750 μm and the coupled line length Lcp was elongated to 50 mm in the structure of Working Example 2-3 was fabricated. A comparison of crosstalk intensity between Working Example 2-4 and Prior Art Example 2 (Lcp=50 mm) is shown in FIG. 24, where the vertical axis represents crosstalk characteristic S41 (dB) and the horizontal axis represents frequency (GHz). As apparent from FIG. 24, a successful crosstalk suppression effect was obtained over the entire frequency band of measurement. A pulse with a voltage of 1 V and a rise/fall time of 50 picoseconds was applied in Working Example 2-4, and crosstalk waveform at its far-end crosstalk terminals was measured. This condition is the same as that of crosstalk waveform measurement with the transmission line pair Prior Art Example 2 shown in FIG. 31. Also, FIG. 25 shows a measurement result of crosstalk waveform in the time domain with Working Example 2-4 and Prior Art Example 2 (both with Lcp=50 mm), wherein the vertical axis represents voltage (V) and the horizontal axis represents time (nsec). As apparent from FIG. 25, whereas a crosstalk voltage of 175 mV was generated in the transmission line pair of Prior Art Example 2, the crosstalk intensity was able to be suppressed to 45 mV, which is one quarter of the above intensity, in Working Example 2-4. It is noted that as the D dependence of crosstalk intensity of Working Example 2-3 has been shown in FIGS. 23A and 23B, the voltage of the crosstalk signal resulted in a sign opposite to the conventional counterpart because the setting of D in Working Example 2-4 was lower than the D2 value (1.6×W=800 μm).

It is to be noted that, by properly combining the arbitrary embodiments of the aforementioned various embodiments, the effects possessed by them can be produced.

Although the present invention has been fully described in connection with the preferred embodiments thereof with reference to the accompanying drawings, it is to be noted that various changes and modifications are apparent to those skilled in the art. Such changes and modifications are to be understood as included within the scope of the present invention as defined by the appended claims unless they depart therefrom.

The transmission line, transmission line pair or transmission line group according to the present invention is capable of suppressing unwanted radiation toward vicinal or neighboring spaces and conducting transmission of signals at low loss without causing signal leakage to peripheral circuits or adjacent transmission lines, and eventually capable of fulfilling both circuit area reduction by dense wiring and high-speed operations of the circuit, which has conventionally been difficult to achieve because of signal leakage, at the same time. Further, the present invention can be widely applied also to communication fields such as filters, antennas, phase shifters, switches and oscillators, and moreover is usable also in power transmission or fields involving use of radio-technique such as ID tags.

The disclosure of Japanese Patent Application No. 2005-97370 filed on Mar. 30, 2005, including specification, drawing and claims are incorporated herein by reference in its entirety.

What is claimed is:

1. A transmission line pair comprising:

a substrate comprising a dielectric or semiconductor;

one first signal conductor which is placed on one surface of the substrate;

one second signal conductor which is placed on the one surface of the substrate; and a grounding conductor layer which is placed on another surface of the substrate, wherein each of the first signal conductor and the second signal conductor has a plurality of rotational-direction reversal structures, each structure arranged so as to be electrically connected to one another in series from one end-side to the other end-side of the substrate, each of the plurality of rotational-directions reversal structures comprising:

a first signal conductor portion which is arranged so as to be curved toward a first rotational direction within the one surface of the substrate; and a second signal conductor portion which is arranged so as to be curved toward a second rotational direction opposite to the first rotational direction within the one surface of the substrate and is placed in the one surface of the substrate so as to be electrically connected in series to the first signal conductor, wherein each of the plurality of the rotational-direction reversal structures has a transmission-direction.

2. The transmission line pair as defined in claim 1, wherein the first signal conductor and the second signal conductor are equal in line length to each other.

3. The transmission line pair as defined in claim 1, wherein a center-to-center distance of the first and second signal conductors is set to 1.1 to 2 times as large as a width of each of the first and second conductors.

4. The transmission line pair as defined in claim 1, wherein the first signal conductor and the second signal conductor are placed so as to be in mirror symmetry to each other.

5. The transmission line pair as defined in claim 1, wherein in each of the first and second signal conductors, the transmission-direction reversal portion has a signal transmission direction which is a direction having an angle of more than 90 degrees with respect to a signal transmission direction from the one end-side to the other end-side of the substrate.

6. A transmission line group in which at least one pair of the transmission line pair as defined in claim 1 is given a differential signal so as to function as differential transmission lines.

7. The transmission line pair as defined in claim 1, wherein in each of the first and second signal conductors, the curve of each of the first signal conductor portion and the second signal conductor portion is circular-arc shaped.

8. The transmission line pair as defined in claim 1, wherein in each of the first and second signal conductors, the first signal conductor portion and the second signal conductor portion are placed in rotational point symmetry with respect to a center of a connecting portion between the first signal conductor portion and the second signal conductor portion.

9. The transmission line pair as defined in claim 1, wherein in each of the first and second signal conductors, each of the first signal conductor portion and the second signal conductor portion has the curved shape having a rotational angle of 180 degrees or more.

* * * * *